US008616793B2

(12) United States Patent
Kasugai et al.

(10) Patent No.: US 8,616,793 B2
(45) Date of Patent: Dec. 31, 2013

(54) LABEL PRODUCING APPARATUS

(75) Inventors: Atsushi Kasugai, Nagoya (JP); Keiji Seo, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 544 days.

(21) Appl. No.: 12/883,235

(22) Filed: Sep. 16, 2010

(65) Prior Publication Data

US 2011/0076084 A1 Mar. 31, 2011

(30) Foreign Application Priority Data

Sep. 30, 2009 (JP) ..... 2009-226174

(51) Int. Cl.
*B41J 15/00* (2006.01)

(52) U.S. Cl.
USPC ..... 400/613; 400/621

(58) Field of Classification Search
USPC ..... 400/613
See application file for complete search history.

(56) References Cited

U.S. PATENT DOCUMENTS

| | | | | |
|---|---|---|---|---|
| 6,158,342 | A * | 12/2000 | Moore | 101/407.1 |
| 6,629,666 | B2 * | 10/2003 | Lee et al. | 242/563 |
| 7,104,712 | B2 | 9/2006 | Sugimoto et al. | |
| 7,306,387 | B2 | 12/2007 | Sugimoro et al. | |
| 7,381,002 | B2 | 6/2008 | Sugimoto et al. | |
| 7,441,972 | B2 | 10/2008 | Sugimoto et al. | |
| 7,819,599 | B2 * | 10/2010 | Kobayashi et al. | 400/621 |
| 7,909,522 | B2 * | 3/2011 | Heaton et al. | 400/613 |
| 8,096,714 | B2 * | 1/2012 | Siebert et al. | 400/94 |
| 8,182,163 | B2 * | 5/2012 | Kuo et al. | 400/619 |
| 2003/0159603 | A1 | 8/2003 | Lee et al. | |
| 2005/0271449 | A1 | 12/2005 | Hirte et al. | |
| 2006/0216098 | A1 * | 9/2006 | Lyman | 400/613 |
| 2007/0212150 | A1 | 9/2007 | Sugimoto et al. | |

FOREIGN PATENT DOCUMENTS

| | | |
|---|---|---|
| EP | 0 914 960 | 5/1999 |
| JP | 05-304103 | 11/1993 |
| JP | 11-116069 | 4/1999 |
| JP | 11-246084 | 9/1999 |
| JP | 2005194026 | 7/2005 |
| JP | 2009-173353 | 8/2009 |

OTHER PUBLICATIONS

Japanese Office Action issued in Japanese Application No. 2009-226174 on Apr. 9, 2013.

* cited by examiner

*Primary Examiner* — Anthony Nguyen
(74) *Attorney, Agent, or Firm* — McCarter & English, LLP

(57) ABSTRACT

The disclosure discloses a label producing apparatus comprising: a roll housing part that houses a roll winding a print-receiving tape into a roll shape; a feeding roller that feeds out and transports said print-receiving tape from said roll housed in said roll housing part; a printing device that prints desired print on said print-receiving tape fed out from said roll by the feeding of said feeding roller; and a guide device that guides said print-receiving tape fed out from said roll housed in said roll housing part; wherein: said guide device comprises either a first guide part capable of guiding said roll according to roll diameters of different sizes, or a second guide part capable of guiding said roll according to roll widths of different sizes.

16 Claims, 20 Drawing Sheets

LABEL PRODUCING APPARATUS

CROSS-REFERENCE TO RELATED APPLICATION

The present application claims priority from Japanese Patent Application No. 2009-226174, which was filed on Sep. 30, 2009, the disclosure of which is incorporated herein by reference in its entirety.

BACKGROUND

1. Field

The present disclosure relates to a label producing apparatus that produces printed labels by printing desired print on a print-receiving tape.

2. Description of the Related Art

Various label producing apparatuses are known which produce printed labels by printing desired print on a print-receiving tape. Such a label producing apparatus houses a roll winding the print-receiving tape into a roll shape in a roll housing part, feeds out the print-receiving tape from the roll by a feeding device, and prints predetermined print on the print-receiving tape by a printing device. The print-receiving tape on which printing has thus been performed is then discharged outside the housing and, in such a state, the roll side is cut by a cutting device. Thus, printed labels are produced.

At times, a tape in which a label mount separated in advance to a predetermined size is disposed on a separation sheet is used as the above-described print-receiving tape. In such a case, predetermined print is printed on the label mount disposed on the separation sheet by the printing device while the print-receiving tape is fed out from the roll. Then, once the print-receiving tape is discharged, the label mount with print is separated from the separation sheet and used.

In a label producing apparatus such as described above, the print-receiving tape needs to be fed out in a predetermined direction from the roll. Here, prior art has proposed to provide on the roll side a guide member that guides the width direction of the print-receiving tape. The label producing apparatus of this prior art is designed so that a roll holder that rotatably holds a roll is mounted to the roll housing part, and the guide member is provided to the roll holder. Additionally, a plurality of groove parts are provided on the downstream side of the roll housing part in the tape feed-out direction, in accordance with the plurality of width dimensions of the roll. Then, when the roll holder is mounted, the front end of the guide member is inserted into the groove part of the above-described plurality of groove parts that corresponds to the width of the roll to be mounted. With this action, the roll holder is positioned. Additionally, in this label producing apparatus, the feeding path of the print-receiving tape starts at the feed-out position where the print-receiving tape is fed out from the roll, curves along a curve-shaped wall, passes through the printing position of the printing device, and arrives at the discharge position. The above-described guide member further comprises a feeding guide part that guides the width direction of the print-receiving tape along the feeding path after the print-receiving tape has been thus fed out. This feeding guide part extends so that it covers the area from the feed-out position of the above-described print-receiving tape to the position where the feeding path curves.

The front end of the guide member provided to the above-described prior art is inserted into the groove part of the plurality of groove parts provided to the roll housing part that corresponds to the width of the roll to be mounted, making it possible to produce printed labels using a plurality of rolls having different width dimensions. Nevertheless, with this configuration, only rolls of a few predetermined types of widths are supported while rolls of arbitrary widths are not.

In response to the above, a guide member that can advance and retreat may be provided to the roll housing part along the width direction of the roll to permit support of arbitrary widths. With this arrangement, the guide member is advanced and retreated to adjust its position in accordance with the width of the housed roll, making it possible to support a roll of an arbitrary width and guide the width direction of the print-receiving tape.

With such a configuration, the advance and retreat operation of the guide member may be performed by having the user pinch the guide member by catching and holding one finger between the guide member and roll and another finger on the side of the guide member that is opposite the roll. Nevertheless, in such a case, since the guide member guides the width direction of the print-receiving tape while in contact with the end face of the roll, the space in which the user is to catch and hold his or her finger between the guide member and roll is difficult to secure when the outer diameter of the roll is large, for example, bringing rise to problems such as a decrease in guide member operability.

On the other hand, in the label producing apparatus of the above-described prior art, the outer diameter of the roll housed in the roll housing part gradually decreases as the print-receiving tape is fed out. As a result, the feed-out position of the print-receiving tape gradually moves as the roll outer diameter decreases, causing the feeding path of the print-receiving tape immediately after roll feed-out to also change in accordance with the roll outer diameter.

Here, in the above-described prior art, the feeding guide part provided to the guide member is provided so that it covers the area from the feed-out position of the print-receiving tape to the position where the feeding path curves, as described above. Nevertheless, in the range from the feed-out position to the curvature position, the feeding path of the print-receiving tape changes according to the change in value of the roll outer diameter as described above, resulting in the possibility that the feeding guide part will not be able to stably guide the width direction of the print-receiving tape.

SUMMARY

It is therefore a first object of the present disclosure to provide a label producing apparatus capable of reliably guiding a print-receiving tape even when the roll width or outer diameter changes to a different value.

It is a second object of the present disclosure to provide a label producing apparatus capable of supporting a roll of an arbitrary width.

It is a third object of the present disclosure to provide a label producing apparatus that makes it possible for a user to easily advance and retreat a guide member, even in a case where the roll outer diameter is large.

It is a fourth object of the present disclosure to provide a label producing apparatus capable of reliably guiding the width direction of the print-receiving tape even if the roll outer diameter changes.

In order to achieve the above-described first object, according to the first aspect, there is provided a label producing apparatus comprising: a roll housing part that houses a roll winding a print-receiving tape into a roll shape; a feeding roller that feeds out and transports the print-receiving tape from the roll housed in the roll housing part; printing device that prints desired print on the print-receiving tape fed out from the roll by the feeding of the feeding roller; and guide device that guides the print-receiving tape fed out from the roll housed in the roll housing part; wherein: the guide device comprises at least one of a first guide part capable of guiding the roll according to roll diameters of different sizes, and a second guide part capable of guiding the roll according to roll widths of different sizes.

According to the first aspect of the present application, the print-receiving tape fed out from the roll housed in the roll housing part is guided by guide device. This guide device comprises a first guide part and a second guide part. The first guide part is capable of supporting and guiding rolls having roll diameters of different sizes. The second guide part is capable of supporting and guiding rolls having roll widths of different sizes. Such a function of the first guide part or the second guide part provided to the guide member makes it possible to reliably guide the print-receiving tape even when the roll width or outer diameter changes to a different value.

In order to achieve the above-described first and second object, according to the second aspect, in the label producing apparatus according to the first aspect, the guide device comprises the second guide part; the roll housing part comprises a fixed wall part and houses the roll with an end face on one side of the roll along a width direction in contact with the fixed wall part; and the second guide part is a guide member that is provided in a manner that can advance to and retreat from the fixed wall part of the roll housing part, along a width direction of the roll, and guides a side of the print-receiving tape fed out from the roll in a width direction by contacting an end face on the other side of the roll along a width direction.

According to the second aspect of the present application, the guide member is provided to the fixed wall part so that can advance and retreat along the width direction of the roll. With this arrangement, the guide member advances and retreats to adjust its position in accordance with the width of the housed roll, making it possible to insert a roll of an arbitrary width between the fixed wall part and guide member and guide the side of the print-receiving tape in the width direction. Thus, the present disclosure is capable of supporting a roll of an arbitrary width.

Further, in a case where a roll is used that has a guide member provided in advance to the roll side, the guide member is discarded after use. In such a case, however, the guide member is generally made of resin, resulting in a significant load on the environment. In contrast, the second aspect of the present application provides the guide member on the label producing apparatus, eliminating the need for discard and reducing the environmental load.

In order to achieve the above-described first and third object, according to the third aspect, in the label producing apparatus according to the second aspect, the guide member further comprises a grasping part disposed between the grasping part and an end face on the other side of the roll along a width direction, that forms a grasping space which the user can grasp with a finger when advancing and retreating the guide member.

The fixed wall part of the roll housing part comes in contact with the end face on one side of the roll along the width direction, and the guide member advances and retreats with respect to the fixed wall part in accordance with the width of the housed roll, thereby contacting the end face on the other side of the roll along the width direction. With this arrangement, the roll is housed in the roll housing part while inserted between the fixed wall part and the guide member and, in this state, the guide member guides the side of the print-receiving tape in the width direction, fed out from the roll.

At this time, according to the third aspect of the present application, a grasping part is provided to the guide member so that a grasping space is formed that makes it possible for the user to catch and hold his or her finger in the area between the grasping part and the other side of the roll along the width direction. The advance and retreat operation of the above-described guide member is then performed by having the user catch and hold his or her finger onto the grasping part of the guide member. The grasping part makes it possible to secure the grasping space between the grasping part and the end face of the roll, regardless of any change in the outer diameter of the roll as the print-receiving tape is fed out. With this arrangement, the user can easily advance and retreat the guide member, even in a case of a large roll outer diameter.

In order to achieve the above-described first and fourth object, according to the fourth aspect, in the label producing apparatus according to the first aspect, the guide device comprises the first guide part; the first guide part is a feeding guide member that is provided on a feeding path of the print-receiving tape, between a first curvature position where the feeding path first curves after feed-out from the roll and a feeding roller position where the feeding roller and the print-receiving tape come in contact, and guides a side of the print-receiving tape fed by the feeding roller in a width direction.

In the label producing apparatus, in general, the roller, curved wall surface, and the like provided on the feeding path come in contact with the print-receiving tape in accordance with the shape, layout, and the like of each device type and member constituting the label producing apparatus, thereby changing the transport direction and thus forming the feeding path into a suitably curved shape.

Here, the outer diameter of the roll housed in the roll housing part gradually decreases as the print-receiving tape is fed out. As a result, the feed-out position of the print-receiving tape gradually moves as the roll outer diameter decreases, causing the feeding path of the print-receiving tape immediately after roll feed-out to also change in accordance with the roll outer diameter.

According to the fourth aspect of the present application, a feeding guide member is provided on the feeding path of the print-receiving tape, between a first curvature position, where the feeding path curves for the first time after feed-out from the roll, and the feeding roller position. At this time, the first curvature position is a position where the feeding path of the print-receiving tape fed out from the roll first curves due to contact with the roller and curved wall surface, etc., making the position of the feeding path of the print-receiving tape at the first curvature position uniform. As a result, even if the feeding path of the print-receiving tape changes immediately after roll feed-out due to a change in the roll outer diameter as described above, the change is limited to the feeding path from the feed-out position to the first curvature position, and the feeding path does not change downstream from the first curvature position. As a result, the width direction of the print-receiving tape can be guided in a section in which a fixed path is formed, regardless of the roll outer diameter, by providing the feeding guide member between the first curvature position and the feeding roller position on the feeding path of the print-receiving tape as described above. With this arrangement, the width direction of the print-receiving tape is reliably guided.

DETAILED DESCRIPTION OF THE PREFERRED EMBODIMENTS

The following describes an embodiment of the present disclosure with reference to accompanying drawings. First, the outer appearance of a label producing apparatus 1 of the embodiment as viewed from above from the front will be described with reference to FIG. 1. Note that the front, rear, left, and right directions in the following descriptions refer to the directions suitably indicated by arrows in each figure, such as FIG. 1.

Figure 1:
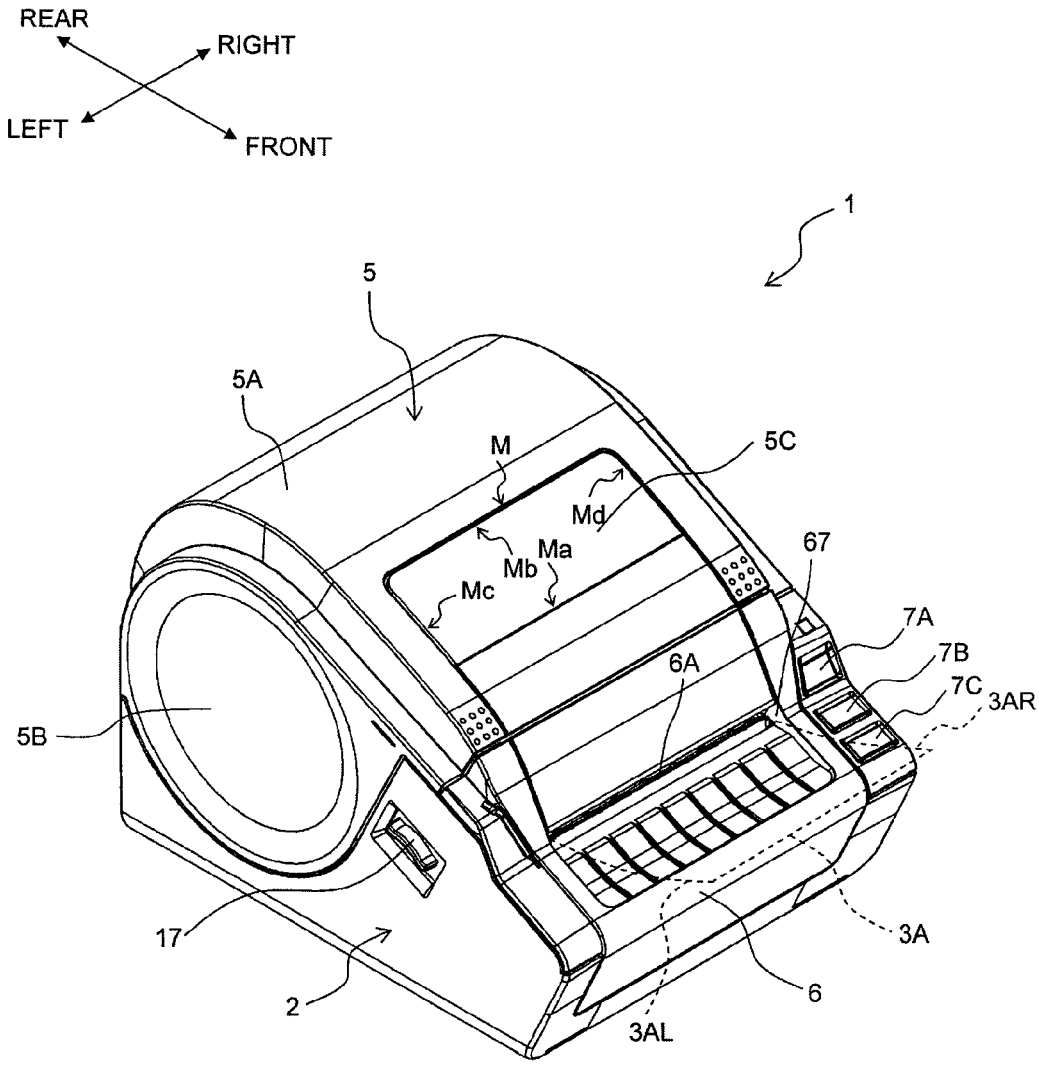
FIG. 1 is a perspective view illustrating the outer appearance of the label producing apparatus of the embodiment, as viewed from above from the front.

In FIG. 1, the label producing apparatus 1 is provided with a housing 2 comprising a front panel 6, and an upper cover 5. The housing 2 and the upper cover 5 are made of resin. The upper cover 5 comprises an upper cover main body 5A and left and right cover members 5B that are substantially circular in shape. The left and right cover members 5B are secured to the left and right of the upper cover main body 5A by screws, etc. The upper cover main body 5A is rotatably connected to the housing 2 on the rear end part so that the upper cover 5 can be opened and closed with respect to the housing 2. Both of the left and right side walls of the housing 2 are provided with a release tab 17 that releases the lock of the upper cover 5 to the housing 2 when pressed upward, making the upper cover 5 releasable. A power button 7A of the label producing apparatus 1, a feed button 7C that discharges a print-receiving tape 3A fed out from a roll 3 in an amount equivalent to a predetermined length, and a cutter button 7B that cuts the print-receiving tape 3A by a cutter unit 8 (refer to FIG. 4 described later) are disposed on either the left or the right side wall of the housing 2, on the upper surface near the front of the side wall on the right side in the example.

A discharging exit 6A is provided on the front panel 6. This discharging exit 6A is for discharging the print-receiving tape 3A with print from the inside to the outside of the housing 2. A transparent window 5C made of a transparent resin that makes it possible to check the roll 3 housed inside the housing 2 is provided to the upper cover 5.

Subsequently, the outer appearance of the label producing apparatus 1 with the roll 3 mounted and not mounted will be described as viewed from above from the front, with reference to FIG. 2 and FIG. 3, respectively. Note that in FIG. 2 and FIG. 3, the upper cover 5 is omitted for clarity of disclosure.

Figure 2:
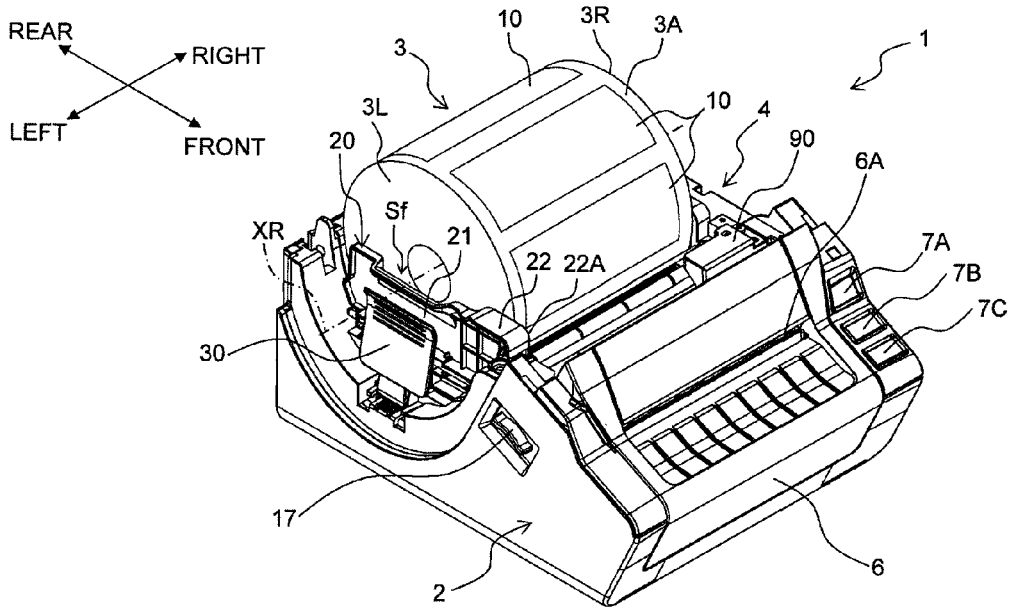
FIG. 2 is a perspective view illustrating the outer appearance of the label producing apparatus as viewed from above from the front, with the upper cover open and the roll mounted.
Figure 3:
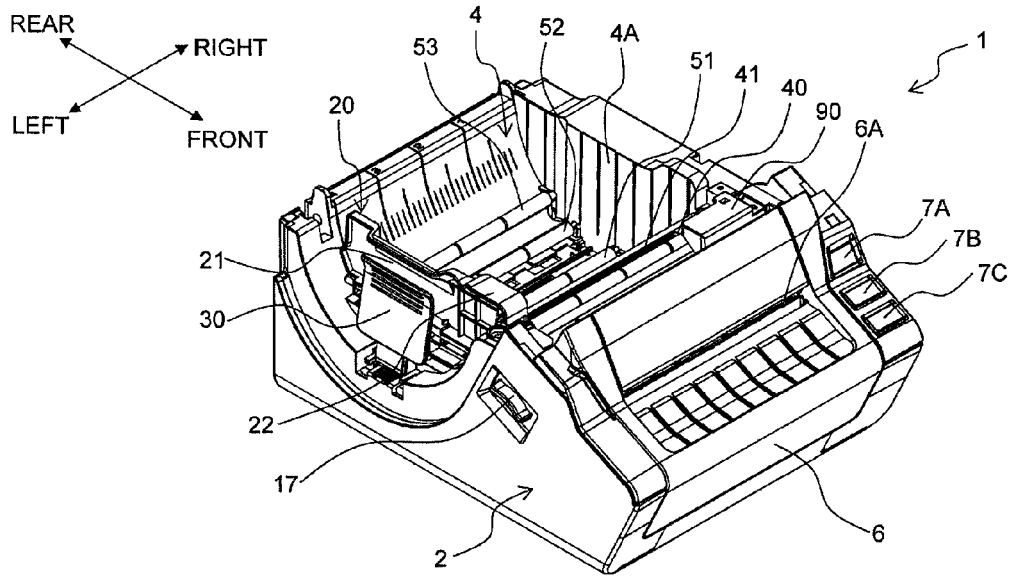
FIG. 3 is a perspective view illustrating the outer appearance of the label producing apparatus as viewed from above from the front, with the upper cover open and the roll removed.

As shown in FIG. 2 and FIG. 3, the label producing apparatus 1 comprises a recessed roll housing part 4 behind the interior space of the housing 2. This roll housing part 4 houses the roll 3 winding the print-receiving tape 3A into a roll shape so that the print-receiving tape 3A is fed out from the lower side of the roll. As illustrated in FIG. 2, a plurality of label mounts 10 (so-called die-cut labels) separated in advance to a predetermined size in accordance with a printed label L to be produced (refer to FIG. 4 described later) is disposed in series on the print-receiving tape 3A, which constitutes the roll 3, along the longitudinal direction at the position of the width center of the print-receiving tape 3A.

The roll housing part 4 comprises a fixed wall part 4A on the right side in the width direction, and rotatably houses the roll 3 while in contact with an end face 3R on one side of the roll 3 in the width direction (the right side in the width direction in this example). A guide member 20 that guides the width direction of the print-receiving tape 3A fed out from the roll 3 by contacting an end face 3L on the other side of the roll 3 in the width direction (the left side in the width direction in this example) is provided to the roll housing part 4. This guide member 20 is advance and retreat possible provided to the fixed wall part 4A along the width direction of the roll 3. With this arrangement, the guide member 20 is advanced and retreated to adjust its position in accordance with the width of the housed roll 3, making it possible to insert the roll 3 of an arbitrary width between the fixed wall part 4A and the guide member 20 and guide the width direction of the print-receiving tape 3A. That is, the roll housing part 4 is capable of housing a plurality of types of the roll 3 winding a plurality of types of the print-receiving tape 3A having different widths. Additionally, an operation member 30 capable of switching between a locked state that disables advance and retreat of the guide member 20, and an unlocked state that enables advance and retreat of the guide member 20 according to a user operation, is provided to the guide member 20. The details of the advancing and retreating structure of the guide member 20 that uses this operation member 30 will be described later.

As illustrated in FIG. 3, three rollers 51 to 53 that dependently rotate and rotatably support the roll 3 by contacting the outer surface of the roll 3 in a quantity of at least two when a platen roller 66 (described later) is rotationally driven by a platen motor (not shown), drawing the print-receiving tape 3A out from the roller 3, are provided to the base surface of the roll housing part 4. These three rollers vary in position in the circumferential direction with respect to the roll 3, and are disposed in the order of the first roller 51, the second roller 52, and the third roller 53, along the circumferential direction of the roll 3, from the front to the back. The first to third rollers 51 to 53 are separated into a plurality (four in this example) of sections in the roll width direction, and only the sections on which the roll 3 is mounted rotate in accordance with the roll width.

A flat surface 40 is provided on the front side of the roll housing part 4. A plurality of groove parts 41 (refer to FIG. 7, etc., described later) is formed on this flat surface 40, along the width direction of the roll. Here, the aforementioned guide member 20 comprises a main body part 21 that contacts the end face 3L on the left side of the roll 3 in the width direction, and an extended part 22 that extends toward the downstream side of the print-receiving tape 3A in the feed-out direction (that is, toward the front). The guide member 20 is provided so that the above-described extended part 22 is mounted on the above-described flat surface 40. Then, a tab 23 (refer to FIG. 8 and FIG. 9 described later) that engages with one of the plurality of grooves 41 provided to the above-described flat surface 40 is provided to the front lower end of a guide surface 22A of the extended part 22. The tab 23 and the groove part 41 engage when the guide member 20 is in a locked state, and disengage when the guide member 20 is in an unlocked state.

The overall structure of the label producing apparatus 1 will now be described with reference to FIG. 4. Note that hereinafter the feeding path of the print-receiving tape 3A fed out and transported from the roll 3 is suitably denoted by the reference numeral "3A" and indicated by an alternate long and short dashed line in each of the figures, including FIG. 4.

Figure 4:
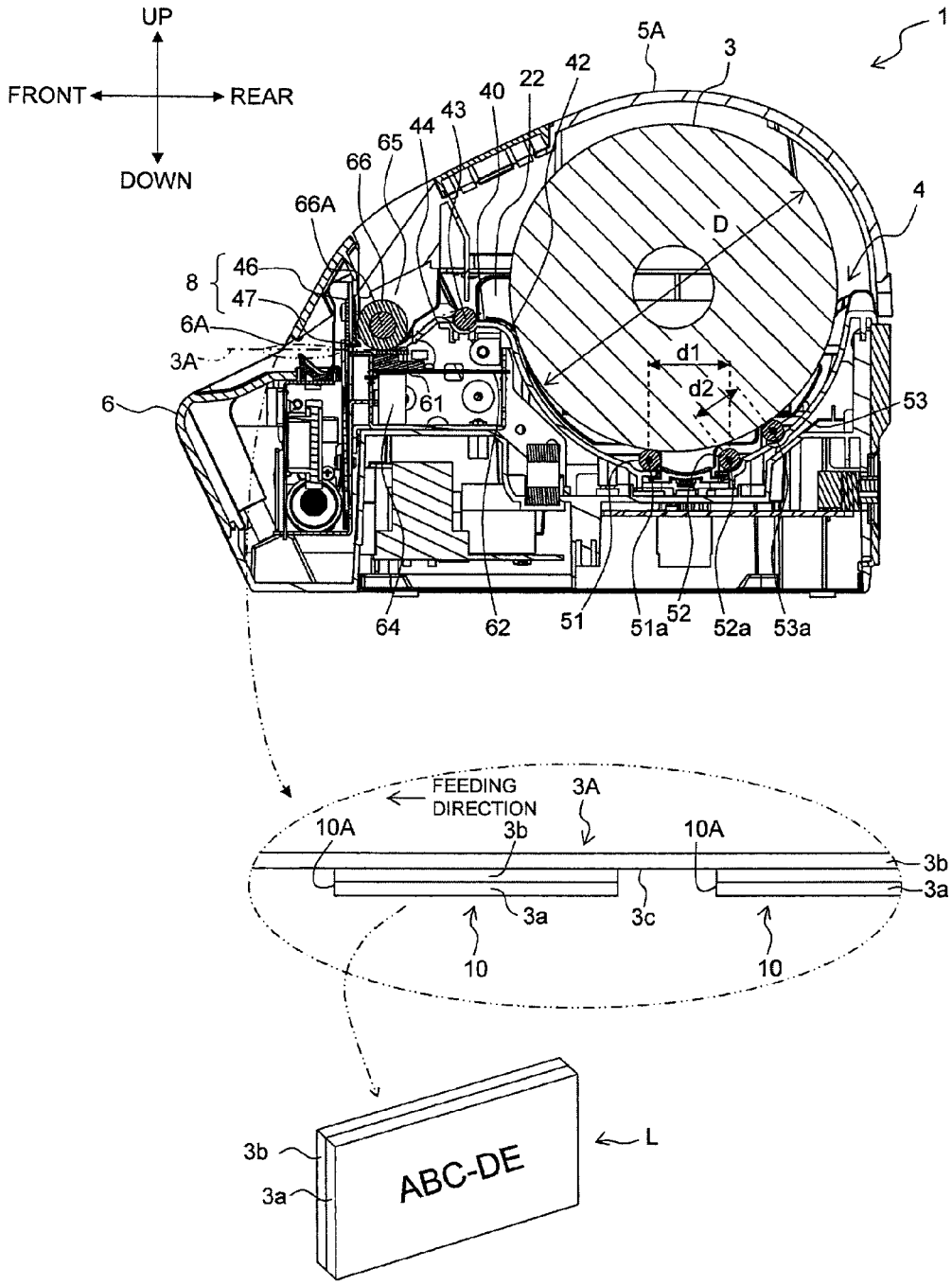
FIG. 4 is a sectional view showing the overall structure of the label producing apparatus.

As illustrated in FIG. 4, a roller shaft 66A of the platen roller 66 that feeds out and transports the print-receiving tape 3A from the roll 3 housed in the roll housing part 4 is rotatably axially supported by a bracket 65 provided to both ends in the axial direction, on the lower side of the front end of the upper cover main body 5A. A gear (not shown) that drives the platen roller 66 is fixed to one shaft end of the roller shaft 66A. The platen roller 66 of the upper cover 5 is installed in a position that corresponds with a print head 61 of the housing 2, and the print-receiving tape 3A is inserted between the platen roller 66 provided to the upper cover 5 side and the print head 61 provided to the housing 2 side by the closing of the upper cover 5, thereby enabling printing by the print head 61. The above-described gear of the platen roller 66 engages with the row of gears (not shown) on the housing 2 side with the closing of the upper cover 5, and the platen roller 66 is rotationally driven by the platen roller motor (not shown) made of a stepping motor or the like, making transport of the print-receiving tape 3A possible.

The print head 61 is fixed to one end of a support member 62 that axially supports the mid-section thereof and is biased upward from a spring member 64. On the other hand, the platen roller 66 is installed to the upper cover 5. As a result, the print head 61 becomes separated from the platen roller 66 when the upper cover 5 is opened by the releasing tab 17, and presses the print-receiving tape 3A against the platen roller 66 by the biasing force of the spring member 64, thereby enabling printing, when the upper cover 5 is closed.

Furthermore, the above-described cutter unit 8 is provided to the downstream side of the print head 61 in the tape feeding direction. The cutter unit 8 comprises a movable blade 47 that forms a V-shape when viewed from the front and is movably disposed by a cutting motor (not shown) in the cutting direction (down to up in FIG. 4) substantially orthogonal to the longitudinal direction of the print-receiving tape 3A, and a fixed blade 46 disposed opposite this movable blade 47.

The label mount 10 is disposed in series to the print-receiving tape 3A, along the longitudinal direction, as previously described. As illustrated in the partially enlarged view in FIG. 4, the label mount 10 has a two-layered structure in this example, and is layered in the order of a thermal layer 3*a* having self-coloring properties and an adhesive layer 3*b*, from the lower side to the upper side in FIG. 4. Then, the label mount 10 is adhered to the surface on one side of a separation sheet 3*c* at a predetermined interval, by the adhesive force of the above-described adhesive layer 3*b*. That is, the print-receiving tape 3A is a three-layered structure comprising the thermal layer 3*a*, the adhesive layer 3*b*, and the separation sheet 3*c* in a section where the label mount 10 is adhered, and a one-layered structure of only the separation sheet 3*c* in a section where the label mount 10 is not adhered (that is, in a section between two of the label mounts 10). The label mount 10 with print is affixed to a predetermined product, etc., as the printed label L comprising the thermal layer 3*a* and the adhesive layer 3*b* once the separation sheet 3*c* is finally peeled away.

Note that the roll 3 is formed by winding the print-receiving tape 3A into a roll shape so that the above-described label mounts 10 are positioned on the outside in the diameter direction. As a result, as illustrated in FIG. 4, the print-receiving tape 3A is fed out from the lower side of the roll 3 with the surface of the label mount 10 side facing downward, and subjected to printing by the print head 61 disposed on the lower side of the print-receiving tape 3A.

According to the label producing apparatus 1 of the above-described configuration, when the upper cover 5 is closed and the platen roller 66 is subsequently rotationally driven by the platen motor, the print-receiving tape 3A is pulled. With this arrangement, the print-receiving tape 3A is fed out from the roll 3 while the width direction is guided by the main body 21 of the guide member 20 that contacts the end face 3L on the left side of the roll 3 in the width direction. The print-receiving tape 3A fed out from the roll 3 contacts a curved wall surface 42, which is a wall surface of a curved shape, formed between the roll housing part 4 and the aforementioned flat surface 40, thereby curving the feeding path toward the horizontal direction. Then, the print-receiving tape 3A is fed while the width direction is guided by the extended part 22 of the guide member 20 mounted on the flat surface 40, and the feeding path is curved downward by a support roller 43 provided downstream. This support roller 43 is a roller that is provided in a section where the feeding path of the print-receiving tape 3A is highest, and supports the print-receiving tape 3A when dependently rotated.

Subsequently, the print-receiving tape 3A contacts a curved part 44, which is a section formed between the platen roller 66 and the print head 61 where the wall surface curves, thereby further curving the feeding path downward and feeding the print-receiving tape 3A to the contact position of the platen roller 66 and the print head 61. At this time, the print head 61 is driven and controlled so that desired print is printed on the printing surface of the above-described thermal layer 3*c* constituting the label mount 10 of the print-receiving tape 3A. Subsequently, the print-receiving tape 3A is discharged from the discharging exit 6A to on top of front panel 6. Then, when the print-receiving tape 3A has been outputted a predetermined distance from the cutter unit 8, the user operates the cutter button 7B, cutting the print-receiving tape 3A by the cutter unit 8. One or a plurality of label mounts 10 with print is disposed on the cut print-receiving tape 3A, enabling use as the printed label L when the user peels the label from the separation sheet 3*c*.

Advancing and Retreating Structure of Guide Member

Subsequently, the advancing and retreating structure of the guide member 20 that uses the operation member 30 will be described in detail with reference to FIG. 5 to FIG. 13.

Figure 8:
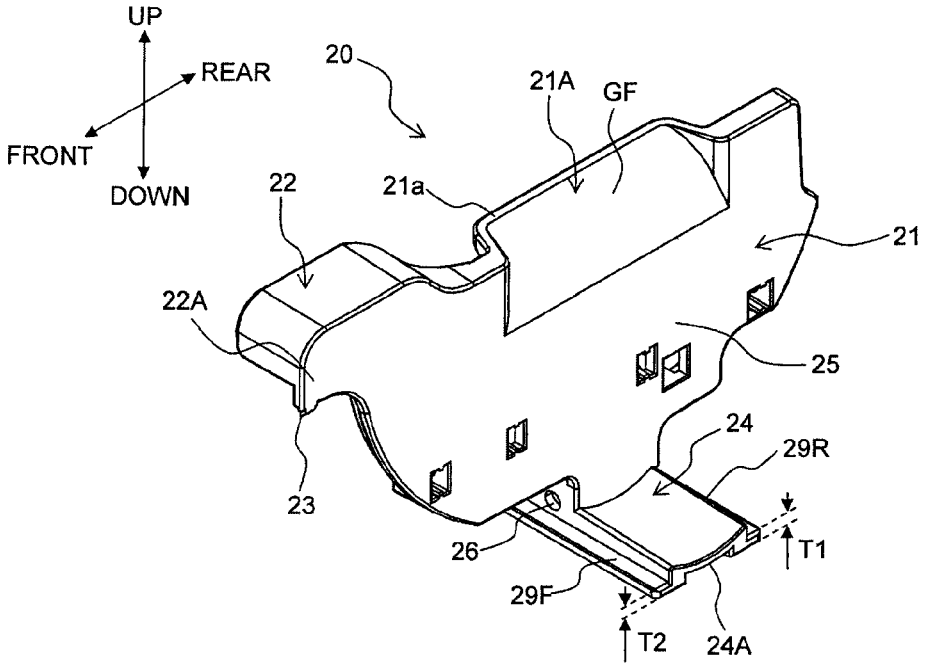
FIG. 8 is a perspective view showing the detailed structure of the guide member, from the roll side.
Figure 9:
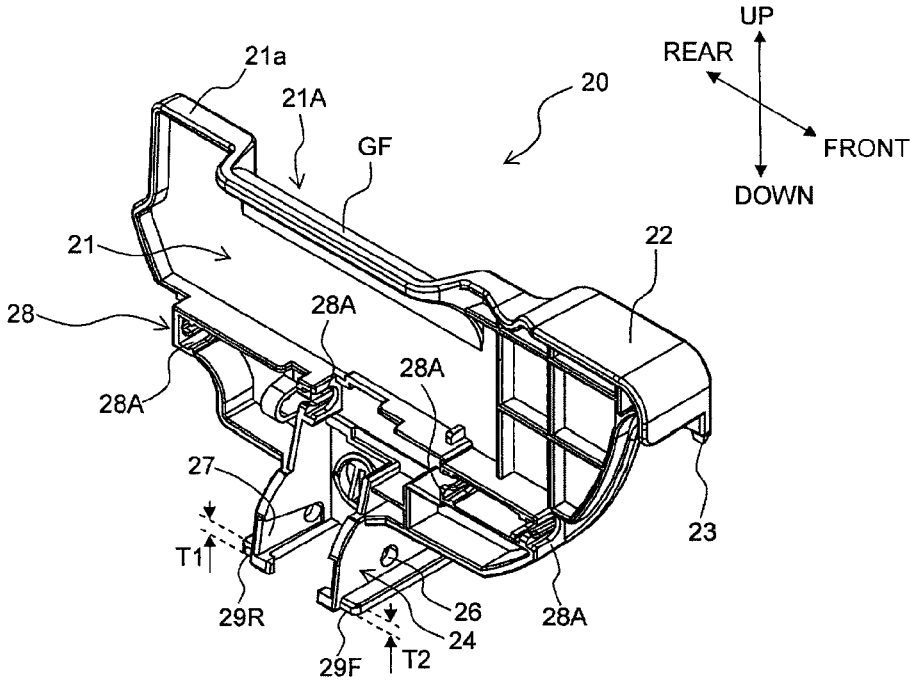
FIG. 9 is a perspective view showing the detailed structure of the guide member, from the operation part side.

As illustrated in FIG. 8 and FIG. 9, the guide member 20 comprises the aforementioned main body 21 that contacts the end face 3L on the left side of the roll 3 in the width direction, the aforementioned extended part 22 that extends toward the downstream side of the print-receiving tape 3A in the feed-out direction, and a support part 24 that supports the main body 21 and the extended part 22. The surface on the roll 3 side of the main body 21 and the extended part 22 constitutes a contact surface 25 that contacts the roll 3. The main body 21 is positioned so that the contact surface 25 contacts the end face 3L on the left side of the roll 3 in the width direction to guide the width direction of the print-receiving tape 3A, and the extended part 22 is positioned so that the contact surface 25 contacts the end part of the fed out print-receiving tape 3A, thereby guiding the width direction of the print-receiving tape 3A.

Figure 6:
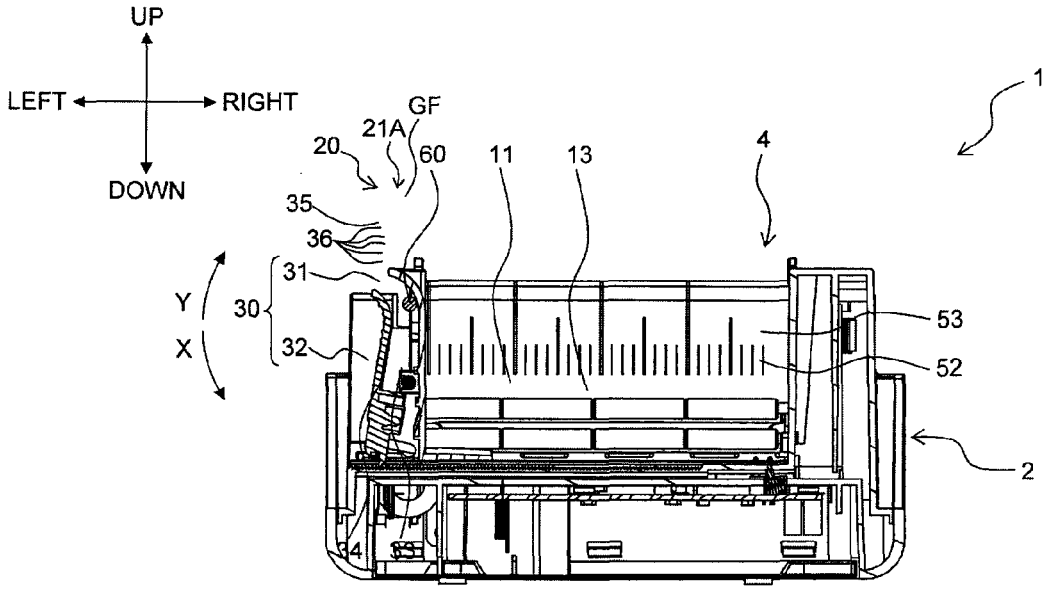
FIG. 6 is a cross-sectional view of the label producing apparatus taken along line VI-VI in FIG. 5.
Figure 10:
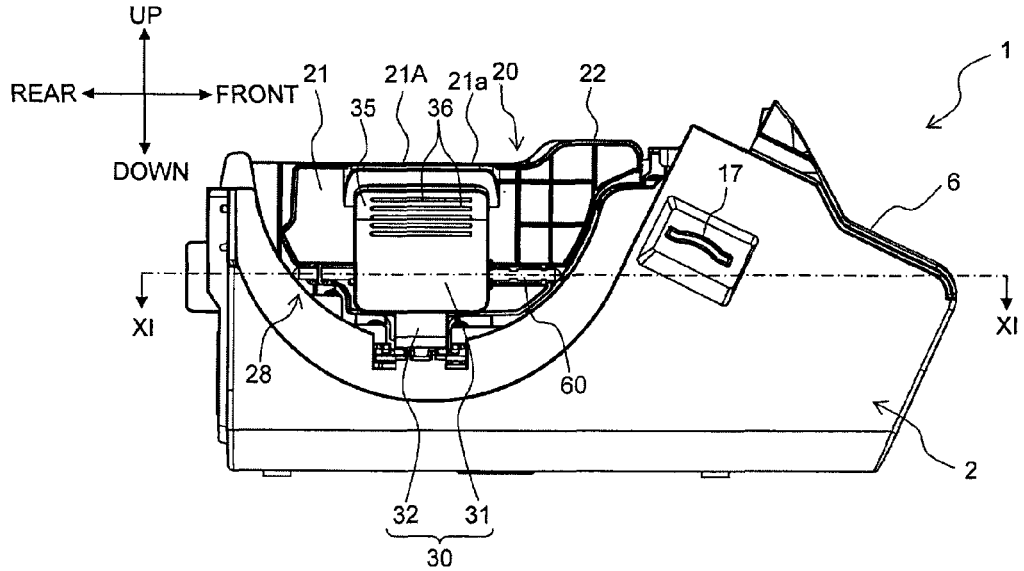
FIG. 10 is a side view showing the overall structure of the label producing apparatus in a state where the operation member has not been operated.

The aforementioned operation member 30 capable of switching between a locked state that disables advance and retreat of the guide member 20, and an unlocked state that enables advance and retreat of the guide member 20 according to a user operation, is provided on the surface opposite the above-described contact surface of the main body 21. The operation member 30 comprises a main body 31 operated by the user with his or her finger, and a support part 32 provided to the lower part of the main body 31, as illustrated in FIG. 6 and FIG. 10. Additionally, the operation member 30 further comprises a rotation support arm 33 that extends toward the guide member 20 on both sides of the support part 32 in the width direction, as illustrated in FIG. 6. This rotation support arm 33 comprises a pin (not shown) that extends toward the outside of the operation member 30 in the width direction at the end part thereof, and this pin engages with a shaft hole 26 (refer to FIG. 8 and FIG. 9) formed on the support part 24 of the guide member 20. At this time, the rotation support arm 33 engages with a recessed part 27 (refer to FIG. 9) largely formed more vertically than the rotation support arm 33 on the support part 24 of the guide member 20. With this arrangement, the operation member 30 is rotatably configured within a rotation range wherein the rotation support arm 33 is engaged with the recessed part 27, with the pin engaged with the shaft hole 26 serving as the center of rotation.

The operation member 30 is biased so that it rotates downward (in the direction indicated by arrow X in FIG. 6) by a spring member (not shown). With this arrangement, the operation member 30 is positioned at the lower end of the rotation range (in a state in which the rotation support arm 33 contacts the lower end part of the recessed part 27) when not operated by the user. At this time, as illustrated in FIG. 6, a tab 34 provided to the lower end of the support part 32 engages with one of the plurality of groove parts 13 provided to a base surface 4C (refer to FIG. 5) of the roll housing part 4, along the width direction of the roll 3.

On the other hand, as illustrated in FIG. 6 and FIG. 10, the main body 31 of the operation member 30 comprises a grip part 35 curved toward the side opposite the guide member 20 on the upper part thereof. This grip part 35 is formed so that a plurality of convex parts 36 linear in shape is provided in parallel in the vertical direction. With the convex parts 36, the user can easily catch and hold his or her finger onto the grip part 35. Further, as illustrated in FIG. 8 and FIG. 9, a grasping part 21A that is recessed toward the operation member 30 is provided to the main body 21 of the guide member 20, at a position opposite the grip part 35 of the above-described operation member 30. With this arrangement, when the user operates the grip part 35 of the operation member 30 using one finger (the thumb, for example), the user catches and holds another finger (the pointer finger or middle finger, for example) onto the grasping part 21A of the guide member 20 so that the guide member 20 is pinched by one finger and the other finger, making it possible to operate the operation member 30.

As a result of the above-described user operation, the operation member 30 resists the biasing force of the aforementioned spring member and rotates upward (in the direction of arrow Y in FIG. 6). With this arrangement, the tab 34 provided to the lower end of the operation member 30 rises, disengaging the engaged state of the tab 34 and groove part 13. That is, the tab 34 of the operation member 30 and the groove part 13 provided to the base surface 4C of the roll housing part 4 disengage when the user operates the operation member 30, and engage when the user stops operating the operation member 30.

Further, the user can perform operations using the operation member 30 regardless of whether the aforementioned tab 23 provided to the front lower end of the extended part 22 of the guide member 20 and the aforementioned groove part 41 provided to the flat surface 40 are engaged or disengaged. A detailed description follows.

Figure 11:
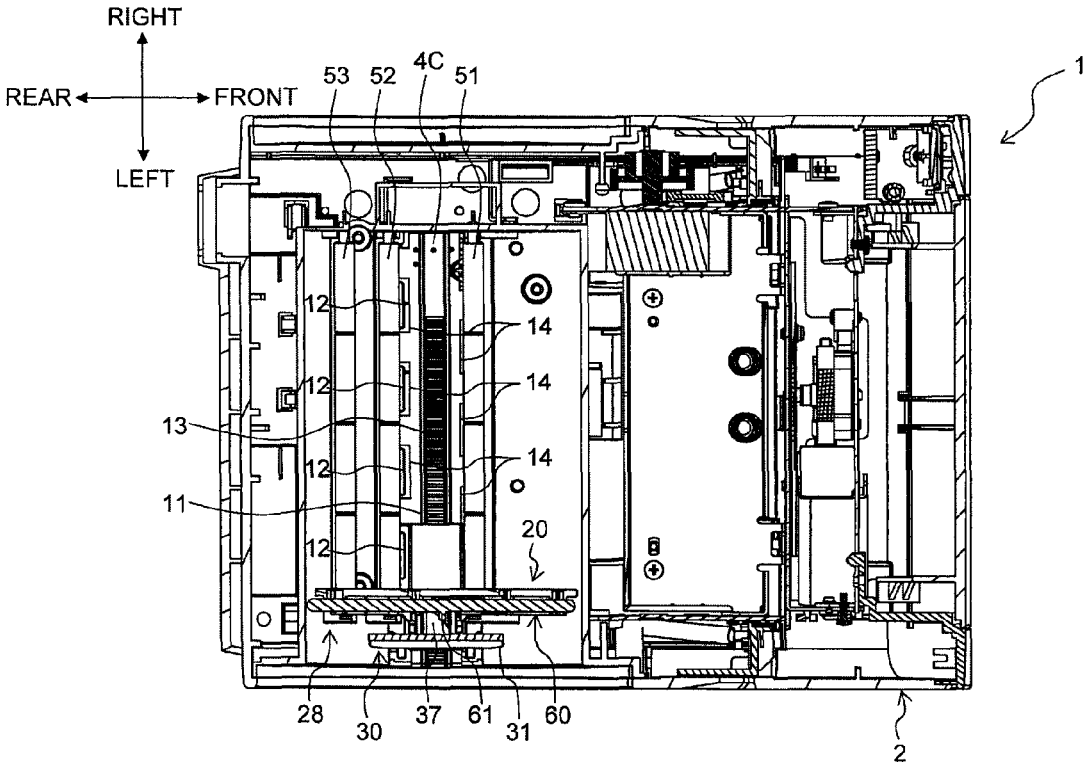
FIG. 11 is a horizontal cross-sectional view of the label producing apparatus taken along line XI-XI in FIG. 10.

As illustrated in FIG. 9, the guide member 20 comprises a shaft housing part 28 that houses a shaft member 60 (refer to FIG. 10 and FIG. 11) that slides in the direction orthogonal to the roll width direction (that is, the front-back direction) in accordance with the operation state of the operation member 30, on the side opposite the contact surface 25 of the main body 21. This shaft housing part 28 comprises a plurality (four in this example) of support parts 28A that support in a slidable manner the shaft member 60 within a predetermined sliding range, with both ends in the shaft direction thereof open. The shaft member 60 is biased by the spring, member (not shown) toward one side in the axial direction (rear side in the example). With this arrangement, the shaft member 60 is positioned in the rear end most position in the above-described sliding range when the user is not operating the operation member 30. In this state, as illustrated in FIG. 10 and FIG. 11, the shaft member 60 extends upstream from the guide member 20 in the feed-out direction of the print-receiving tape 3A (to the rear side in this example), drawing in the downstream side in the feed-out direction (the front side in this example). With this arrangement, the tab 23 provided to the front lower end of the extended part 22 of the guide member 20 and the groove part 41 provided to the flat surface 40 engage, maintaining the guide member 20 in a locked state.

Figure 7:
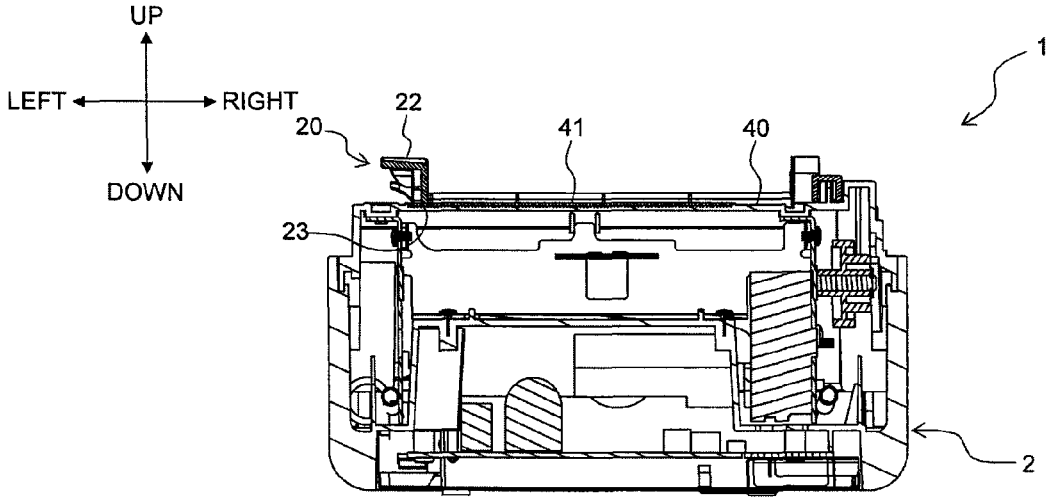
FIG. 7 is a cross-sectional view of the label producing apparatus taken along line VII-VII in FIG. 5.
Figure 12:
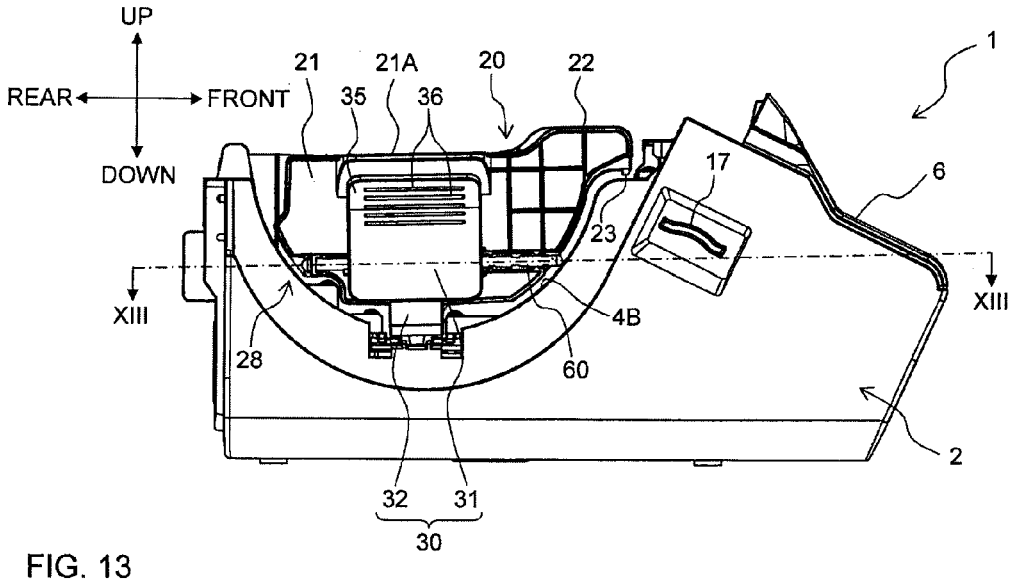
FIG. 12 is a side view showing the overall structure of the label producing apparatus in a state where the operation member has been operated.
Figure 13:
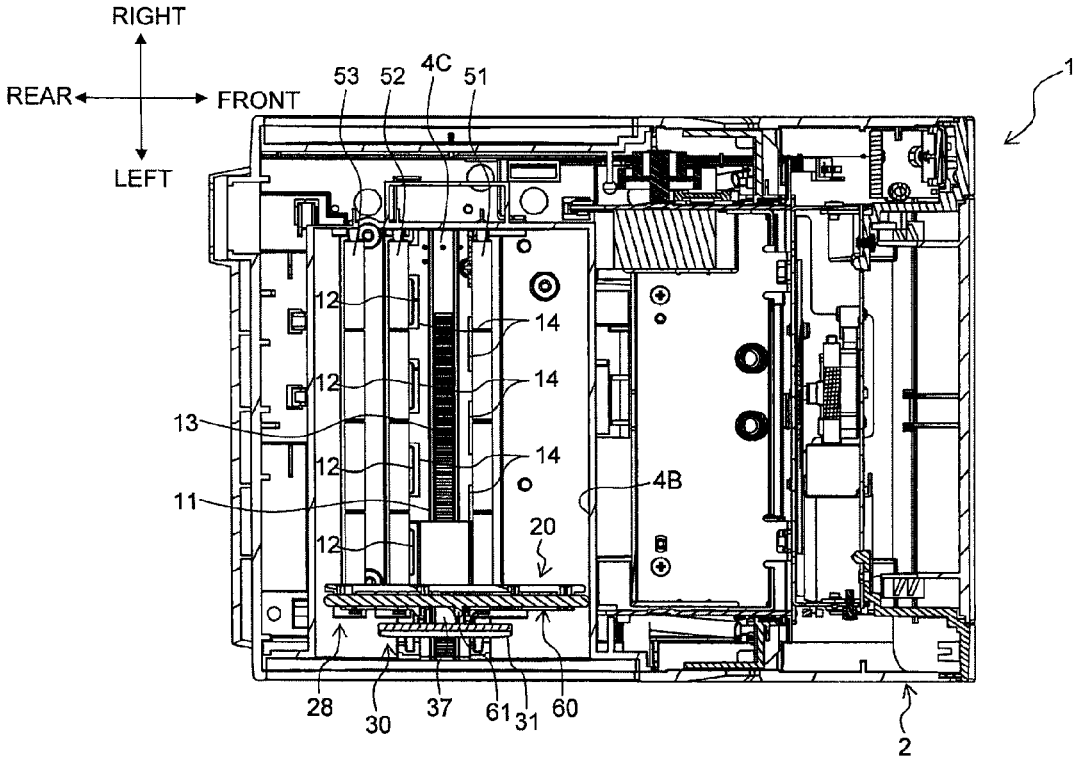
FIG. 13 is a horizontal cross-sectional view of the label producing apparatus taken along line XIII-XIII in FIG. 12.

Here, a cam member 37 is provided to the guide member 20 side of the main body 31 of the operation member 30, as illustrated in FIG. 11. On the other hand, the protruding part 61 that protrudes on the operation member 30 side is provided at a position opposite the above-described cam member 37 of the shaft member 60. With this arrangement, when the operation member 60 is rotated upward (in the direction of arrow Y in FIG. 6) by an operation performed by the user, the above-described cam member 37 contacts the protruding part 61 of the shaft member 60, causing the shaft member 60 to extend from the guide member 20 toward the downstream side (the front side in the example) of the feed-out direction of the print-receiving tape 3A, as illustrated in FIG. 12 and FIG. 13. With this arrangement, the front end of the shaft member 60 contacts an inclined surface 4B of the roll housing part 4, lifting the guide member 20 on the downstream side (front side in the example) in the tape feed-out direction. As a result, as illustrated in FIG. 12, the tab 23 provided to the front lower end of the extended part 22 of the guide member 20 rises, disengaging the groove part 41 provided to the flat surface 40. That is, the tab 23 of the extended part 22 of the guide member 20 and the groove part 41 provided to the flat surface 40 disengage when the user operates the operation member 30, and engage when the user stops operating the operation member 30, as illustrated in FIG. 7.

Figure 5:
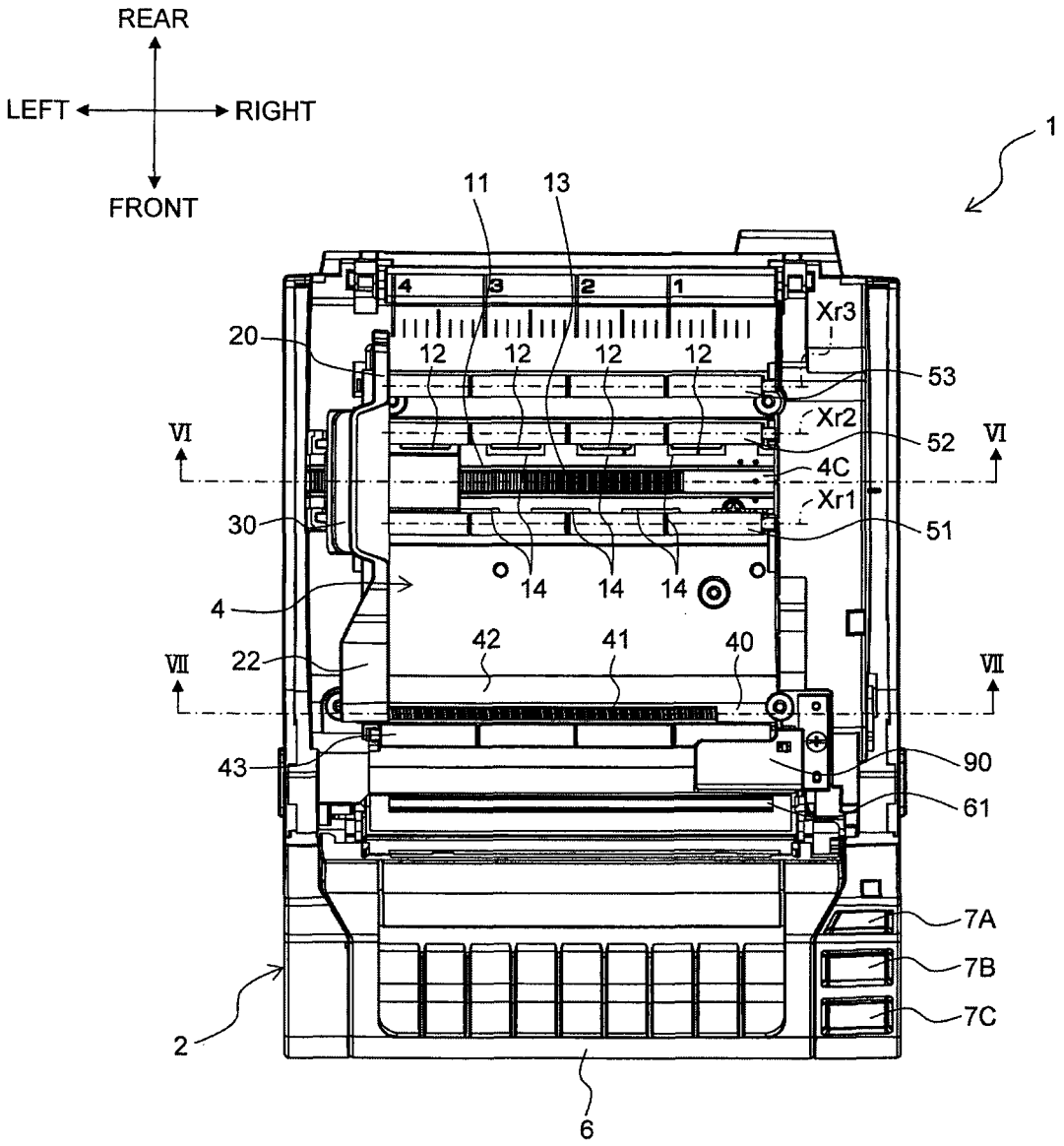
FIG. 5 is a top view showing the overall structure of the label producing apparatus.

Subsequently, the support structure of the guide member 20 will be described. As illustrated in FIG. 5, FIG. 6, etc., a rail member 11 that engages with the support part 24 of the guide member 20 and guides the advance and retreat direction of the guide member 20 is provided to the base surface 4C of the roll housing part 4, along the width direction of the roll 3. That is, the support part 24 of the aforementioned guide member 20 comprises a recessed engaging part 24A on the lower end thereof, as illustrated in FIG. 8, and the above-described rail member 11 engages in a slidable manner with the engaging part 24A, guiding the advance and retreat direction of the guide member 20. Note that the aforementioned groove part 13 is provided on the rail member 11.

Further, an eave part 12 is provided to both sides of the rail member 11 in the width direction, as illustrated in FIG. 5 and FIG. 11. Note that, since the eave member 12 on the front side is hidden by the first roller 51 in FIG. 5 and FIG. 11, only a hole part 14 provided in substantially the same location in the vertical direction as the eave member 12 is shown on the front side. The eave member 12 is provided so that it is positioned above a flange part 29 formed on both sides in the width direction of the engaging part 24A of the above-described support part 24 when the support part 24 engages with the rail member 11, and prevents separation of the support part 24 from the rail member 11 when the flange part 29 is pressed from above. These eave members 12 are staggered along the width direction of the roll 3, on both sides of the rail member 11 in the width direction, as illustrated in FIG. 5 and FIG. 11. Specifically, regardless of the advanced or retreated position of the support part 24, the eave members 12 are staggered so that three or more always overlap with the flange part 29 of the support part 24 in the vertical direction, making it possible to reliably prevent separation of the support part 24 from the rail member 11.

Further, the flange part 29 formed on both sides of the above-described support part 24 in the width direction is configured so that a thickness T1 of a flange part 29R positioned on the upstream side in the feed-out direction of the print-receiving tape 3A (the rear side in this example) is thicker than a thickness T2 of a flange part 29F positioned on the downstream side (the front side in this example). With this arrangement, it is possible to form a gap between the eave part 12 and the flange part 29F positioned on the front side that is greater than a gap between the eave part 12 and the flange part 29R positioned on the rear side. This difference in gap size permits the downstream side of the guide member 20 in the feed-out direction to be lifted by the extension of the aforementioned shaft member 60.

With such a configuration, when the user operates the operation member 30, the tab 34 of the operation member 30 and the groove part 13 provided to the base surface 4C of the roll housing part 4 disengage, and the tab 23 of the extended part 22 of the guide member 20 and the groove part 41 provided to the flat surface 40 disengage, thereby unlocking the guide member 20. With this arrangement, the advance and retreat operation of the guide member 20 with respect to the fixed wall 4A is permitted, making it possible to adjust the position of the guide member 20 in accordance with the roll width when the user operates the operation member 30. Then, once the position is adjusted and the user stops operating the operation member 30, the tab 34 of the operation member 30 and the groove part 13 of the roll housing part 4 engage, and the tab 23 of the extended part 22 of the guide member 20 and the groove part 41 of the flat surface 40 engage, thereby locking the guide member 20. With this arrangement, the advance and retreat operation of the guide member 20 is disabled, making it possible to fix the guide member 20 to the position after adjustment.

Roller Structure Inside Roll Housing Part

Subsequently, the three rollers 51 to 53 provided within the roll housing part 4 will be described in detail.

As previously described, the three rollers 51 to 53 vary in position in the circumferential direction with respect to the roll 3, and are disposed in the order of the first roller 51, the second roller 52, and the third roller 53 along the circumferential direction of the roll 3, from the front to the back. Center axes of rotation Xr1 to Xr3 (refer to FIG. 5) of these three rollers 51 to 53 are each parallel to a center axis of winding XR (refer to FIG. 2) of the roll 3. The positional relationship of the three rollers 51 to 53 is such that, as illustrated in the aforementioned FIG. 4, the third roller 53 is disposed on the opposite side in the feed-out direction of the print-receiving tape 3A (the rear side in this example) than the first and second rollers 51 and 52. Further, a center of axis 51*a* of the first roller 51 and a center of axis 52*a* of the second roller 52 share a horizontal positional relationship (a plane LE that includes the center of axis 51*a* and the center of axis 52*a* is parallel with an installation plane PR), and a center of axis 53*a* of the third roller 53 is disposed higher than the center of axes 51*a* and 52*a* of the first and second rollers 51 and 52. Then, a roller-to-roller distance d1 between the center of axis 51*a* of the first roller 51 and the center of axis 52*a* of the second roller 52 is greater than a roller-to-roller distance d2 between the center of axis 52*a* of the second roller 52 and the center of axis 53*a* of the third roller 53.

Here, the label producing apparatus 1 produces the printed label L by printing desired print on the print-receiving tape 3A fed out from the roll 3 housed in the roll housing part 4. At this time, an outer diameter D of the roll 3 housed in the roll housing part 4 gradually decreases from a maximum value Dmax to an intermediate value Dmid and then to a minimum value Dmin as the print-receiving tape 3A is fed out. Note that the maximum value Dmax is the roll outer diameter when usage begins, and the minimum value Dmin is the roll outer diameter when usage ends. According to the embodiment, the roll 3 having the dimensions Dmax=4 inches (101.6 mm), Dmin=1 inch (25.4 mm)+a thickness of a paper sleeve 3B (described later; 2 mm×2)=29.4 mm is used. That is, the maximum diameter Dmax is three or more times greater than the minimum diameter Dmin. Additionally, the intermediate value Dmid is the roll outer diameter when all three rollers 51 to 53 support the roll 3 (described in detail later) and, in this embodiment, is set to about Dmid=63.5 mm when the above-described roll is used, for example. Then, with the rollers 51 to 53 disposed as described above, the roller configuration that supports the roll 3 varies in accordance with the outer diameter of the roll 3. The details of the change in the roller configuration in accordance with this roll outer diameter will now be described with reference to FIG. 14.

Figure 14A:
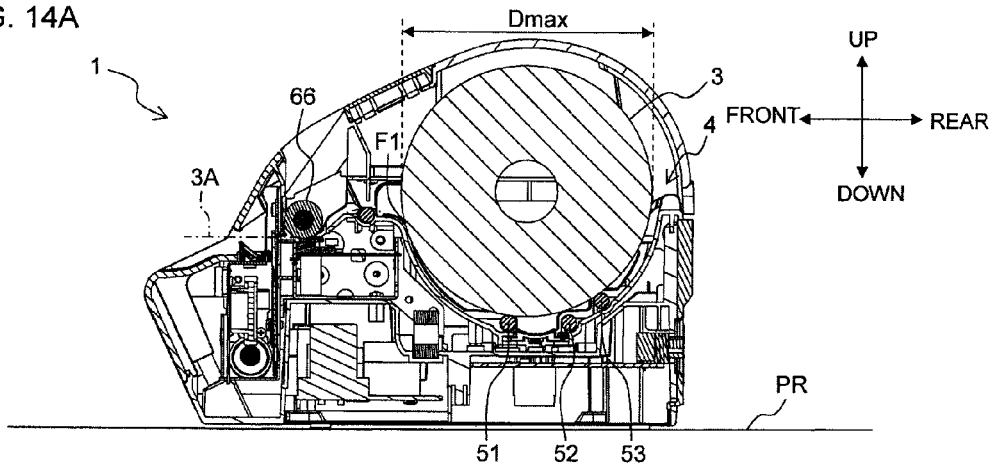
FIG. 14A is a side sectional view of the label producing apparatus for explaining that the rollers supporting the roll differ according to the outer diameter of the roll.
Figure 14B:
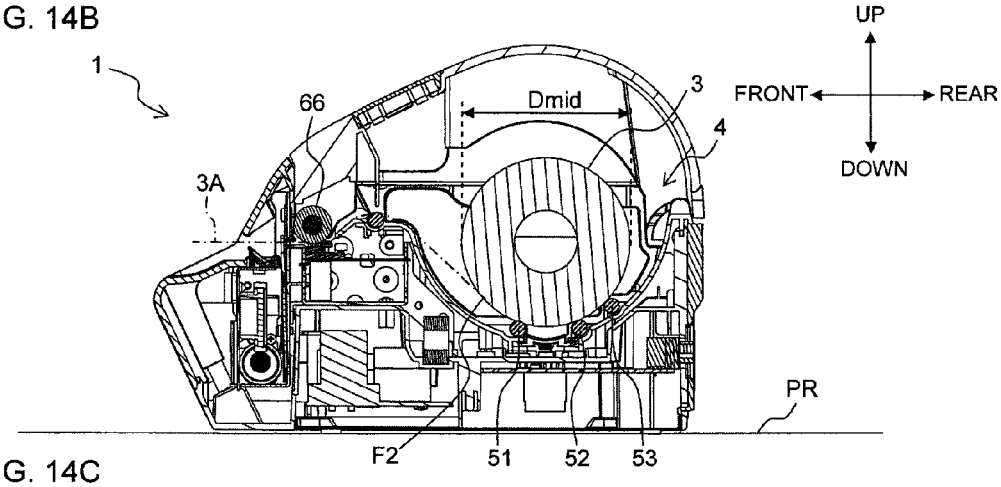
FIG. 14B is a side sectional view of the label producing apparatus for explaining that the rollers supporting the roll differ according to the outer diameter of the roll.

As illustrated in FIG. 14A, when the outer diameter D of the roll 3 is the maximum value Dmax, the second roller 52 and outer surface of the roll 3 separate, causing the roll 3 to be supported by the first roller 51 and the third roller 53. This state of support by these two rollers 51 and 53 continues from the moment the roll outer diameter D equals the maximum value Dmax to just before the roll outer diameter D equals the intermediate value Dmid, as illustrated in FIG. 14B described later. That is, in the range from the maximum value Dmax to just before the intermediate value Dmid in which the roll outer diameter D is relatively large, the roll 3 is supported by the first roller 51 and the third roller 53. With this arrangement, the distance between the rollers that support the roll three is large, making stable support of the roll 3 possible. Further, the following advantages are also achieved.

Figure 14C:
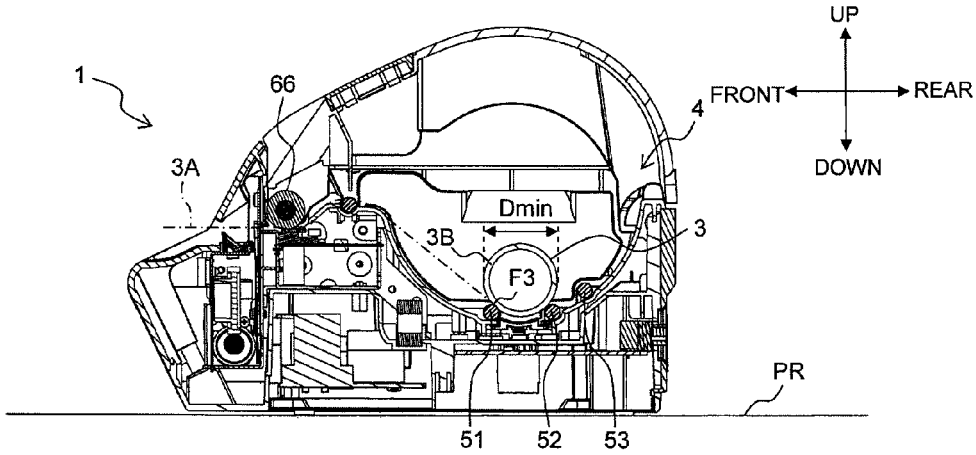
FIG. 14C is a side sectional view of the label producing apparatus for explaining that the rollers supporting the roll differ according to the outer diameter of the roll.

That is, in a case where the print-receiving tape 3A is fed out from the lower side of the roll 3 as in this embodiment, a force acts that attempts to roll the roll 3 toward the side opposite the tape feed-out direction (the rear side in this example). At this time, in the range from the maximum value Dmax to just before the intermediate value Dmid in which the roll outer diameter D is relatively large, the center of gravity of the roll 3 is relatively high, as illustrated in FIG. 14A, thereby increasing the effect of the force that attempts to roll the roll 3 toward the rear side, resulting in the possibility of the roll 3 rolling rearward. On the other hand, in the range from the intermediate value Dmid to the minimum value Dmin in which the roll outer diameter is relatively small as illustrated in FIG. 14C, the center of gravity of the roll 3 is relatively low, thereby decreasing the effect of the above-described force attempting to roll the roll 3 and reducing the possibility that the roll 3 will roll.

According to this embodiment, when the roll outer diameter D is in the range from the maximum value Dmax to just before the intermediate value Dmid, that is, in a range where the center of gravity of the roll 3 is relatively high, the roll 3 is supported by the first roller 51 and the third roller 53 disposed at a high location rearward from the first and second rollers 51 and 52, as previously described. As a result, the aforementioned force that attempts to roll the roll 3 toward the rear side is effectively resisted, making stable support of the roll 3 possible, even when the roll outer diameter D is in the range from the maximum value Dmax to just before the intermediate value Dmid.

Further, in a case where the outer diameter D of the roll 3 reaches the intermediate value Dmid, all rollers including the first roller 51, the second roller 52, and the third roller 53 contact the outer peripheral surface of the roll 3 as illustrated in FIG. 14B, causing the roll 3 to be supported by the three rollers 51 to 53. Thus, when the roll outer diameter D equals the intermediate value Dmid, all rollers including the first roller 51, the second roller 52, and the third roller 53 support the roll 3, making stable support of the roll 3 possible. Additionally, the following advantages are also achieved.

That is, in general, when the platen roller 66 is rotationally driven, feeding out the print-receiving tape 3A from the roll 3, the load applied to tape feed-out, which is caused by the friction of the rollers and the inertia from the weight of the roll 3 itself, increases proportionately with the size of the roll outer diameter D and the number of rollers that support the roll 3. When this load increases beyond a predetermined value, the possibility exists that the print-receiving tape 3A will not be smoothly fed out from the roll 3, causing irregularity in the printing performed by the print head 61.

According to the embodiment, the three rollers of the first roller 51, the second roller 52, and the third roller 53 support the roll 3 when the roll outer diameter D reaches the intermediate value Dmid, as described above. That is, the roll outer diameter D when the number of rollers that support the roll 3 reaches the maximum number 3 can be set to the intermediate value Dmid, resulting in a significant decrease compared to the case of the maximum value Dmax. As a result, the load that occurs when the print-receiving tape 3A is fed out from the roll 3 is reduced, thereby suppressing the occurrence of print irregularities such as described above.

Further, as illustrated in FIG. 14C, when the outer diameter D of the roll 3 is the minimum value Dmin, the third roller 53 and the outer peripheral surface of the roll 3 separate, causing the roll 3 to be supported by the first roller 51 and the second roller 52. Note that the roll 3 at this time is in a state where the entire print-receiving tape 3A has been fed out and the paper sleeve 3B is exposed, and the minimum value Dmin of the roll outer diameter D is equivalent to the outer diameter of the paper sleeve 3B. This state of support by these two rollers 51 and 52 continues from the moment the outer diameter D of the roll 3 decreases from the intermediate value Dmid to the minimum value Dmin, as illustrated in FIG. 14B. That is, in the range in which the roll outer diameter D decreases from the intermediate value Dmid to the minimum value Dmin, which is the range in which the roll outer diameter D is relatively small, the roll 3 is supported by the two rollers of the first roller 51 and the second roller 52. According to this embodiment, the roller-to-roller distance d1 (refer to FIG. 4) between the first roller 51 and the second roller 52 is set to a value smaller than the minimum value Dmin of the roll outer diameter D, making it possible to prevent the falling off of the roll 3 even when the roll outer diameter D reaches the minimum Dmin.

Subsequently, the movement of the center of gravity of the roll in accordance with the roll outer diameter D in a case of such roller support as described above will be described with reference to FIG. 15. Note that the center of gravity of the roll 3 when the roll outer diameter D is Dmax, Dmid, and Dmin is denoted in FIG. 15 as Gmax, Gmid, and Gmin, respectively, for ease of explanation.

Figure 15:
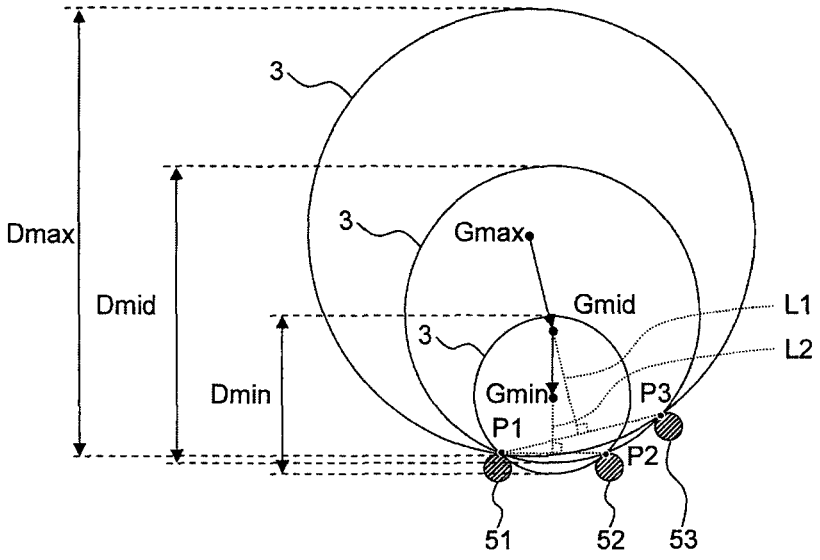
FIG. 15 is a diagram illustrating the movement of the center of gravity of the roll in accordance with the roll outer diameter.

As illustrated in FIG. 15, in the range where the roll outer diameter D decreases from the maximum value Dmax to the intermediate value Dmid, the center of gravity of the roll 3 moves from Gmax to Gmid on a perpendicular bisector L1 of a segment connecting contact points P1 and P3 of the roll 3 and the rollers 51 and 53. In this range, the center of gravity of the roll 3 is high, causing the force that attempts to roll the roll 3 toward the rear side (the right side in FIG. 15) to be dominant over the weight of the roll 3. In consequence, the perpendicular bisector L1 is caused to incline toward the front (toward the left in FIG. 15) as illustrated in the figure, making it possible to effectively resist the force that attempts to roll the roll 3 rearward.

On the other hand, in the range where the roll outer diameter D decreases from the intermediate value Dmid to the minimum value Dmin, the center of gravity of the roll 3 moves from Gmid to Gmin on a perpendicular bisector L2 of a segment connecting contact points P1 and P2 of the roll 3 and the rollers 51 and 52. In this range, the center of gravity of the roll 3 is low, causing the weight of the roll 3 to be dominant over the force that attempts to roll the roll 3 toward the rear side. In consequence, the effect of the force that attempts to roll the roll 3 rearward decreases, making stable support of the roll 3 possible even when the roll 3 is supported by only the rollers 51 and 52 disposed in horizontal positions.

Guide Function of Extended Part

Subsequently, the guide function of the extended part 22 of the guide member 20 will be described in detail.

As previously described, the guide member 20 comprises the main body 21 that contact the end face 3L on the left side of the roll 3 in the width direction, and the extended part 22 that extends toward the downstream side in the feed-out direction of the print-receiving tape 3A (i.e., toward the front side). The main body 21 guides the width direction of the print-receiving tape 3A fed out from the roll 3 by contacting the end face 3L on the left side of the roll 3 in the width direction. Then, the tab 23 that engages with one of the plurality of groove parts 41 provided to the flat surface 40 is provided to the front lower end of the extended part 22. As illustrated in the aforementioned FIG. 8, the extended part 22 comprises the guide surface 22A established on one side of the print-receiving tape 3A in the width direction above the tab 23, and guides the width direction of the print-receiving tape when the guide surface 22A is made to contact the end part on one side in the width direction of the print receiving tape 3A (the left side in the width direction in this example) fed out from the roll 3. Note that the guide surface 22A constitutes one part of the front end of the contact surface 25. That is, the contact surface 25 which includes the guide surface 22A, the extended part 22, and the main body 21 integrally make up the guide member 20.

The guiding of the width direction of the print-receiving tape 3A by the guide surface 22A of the extended part 22 will now be described with reference to FIG. 16. Note that the outer diameters D of the roll 3 shown in FIG. 16 correspond to the maximum value Dmax, intermediate value Dmid, and minimum value Dmin shown in the aforementioned FIG. 14 and FIG. 15.

Figure 16:
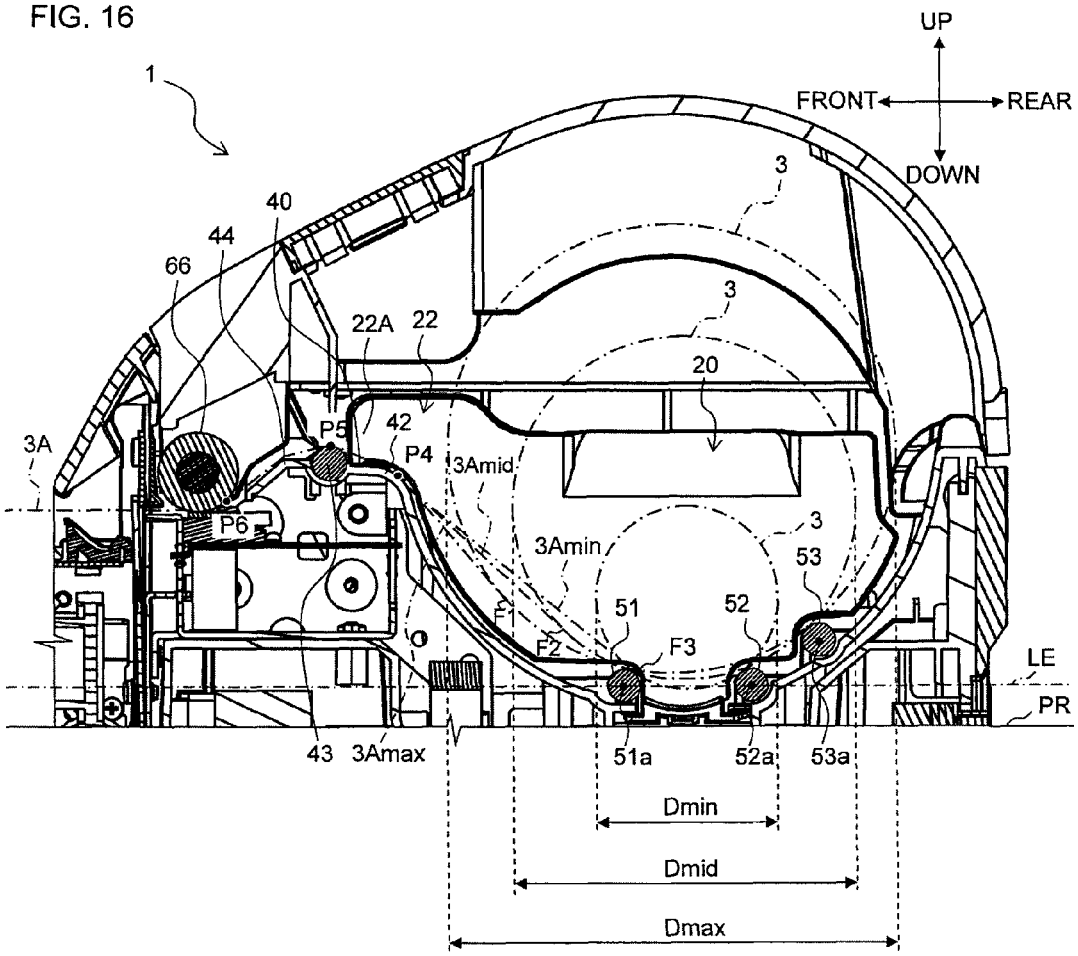
FIG. 16 is aside sectional view of the label producing apparatus showing the guide surface of the extended part guiding the width direction of the print-receiving tape.

As illustrated in FIG. 16, in a state where the extended part 22 is mounted to the flat surface 40 and the tab 23 is engaged with the groove part 41, the guide surface 22A of the extended part 22 is provided between a contact position P4 (hereinafter "first curvature position P4") of the aforementioned curved wall surface 42 where the feeding path first curves after feed-out positions F1, F2, and F3 from the roll 3, and a position P6 (hereinafter "platen roller position P6") where the platen roller 66 and the print-receiving tape 3A come in contact. More specifically, the guide surface 22A is provided on the feeding path of the print-receiving tape 3A, between the first curvature position P4 and a position P5 (hereinafter "second curvature position P5"), which is the next position where the feeding path curves after the first curvature position P4 and the position where the print-receiving tape 3A and the aforementioned support roller 43 that supports the print-receiving tape 3A come in contact on the feeding path.

With the guide surface 22A provided to the above-described position, the guide surface 22A is capable of guiding the width direction of the print-receiving tape 3A without being affected by the outer diameter D of the roll 3. This will now be discussed with reference to FIG. 16. That is, the outer diameter D of the roll 3 housed in the roll housing part 4 gradually decreases as the print-receiving tape 3A is fed out. As a result, as illustrated in FIG. 16, the feed-out positions F1, F2, and F3 of the print-receiving tape 3A gradually move with the shrinking of the roll outer diameter D, causing the feeding path of the print-receiving tape 3A immediately after roll feed-out to change in accordance with the roll outer diameter D. In the example shown in FIG. 16, the feeding paths of the print-receiving tape when the roll outer diameter D is the maximum value Dmax, the intermediate value Dmid, and the minimum value Dmin are denoted by 3Amax, 3Amid, and 3Amin, respectively.

At this time, the aforementioned first curvature position P4 is the position where the feeding path of the print-receiving tape 3A fed out from the roll 3 first curves by contact with the curved wall surface 42, making the position of the feeding path of the print-receiving tape 3A at the first curvature position P4 constant. As a result, even if the feeding path of the print-receiving tape 3A changes immediately after roll feed-out due to a change in the roll outer diameter D as described above, the feeding path from the feed-out positions F1, F2, and F3 to the first curvature position P4 is limited, and the feeding path downstream from the first curvature position P4 does not change, as illustrated in FIG. 16. As a result, when the guide surface 22A of the extended part 22 is provided between the first curvature position P4 and the second curvature position P5 of the feeding path of the print-receiving tape 3A as described above, the guide surface 22A is capable of guiding the width direction of the print-receiving tape 3A in a section that serves as a set path regardless of the roll outer diameter D.

Label Mount Peeling Prevention Function of Contacting Members

Subsequently, the peeling prevention function provided to the label mount 10 by the contacting members on the feeding path of the print-receiving tape 3A will be described.

As illustrated in FIG. 16, a plurality of contacting members that contact the surface on the lower side of the print-receiving tape 3A, which is the label mount surface, is provided downstream from the feed-out positions F1, F2, and F3 of the roll 3, on the feeding path of the print-receiving tape 3A. That is, first the curved wall surface 42 contacts the surface on the lower side of the print-receiving tape 3A, which is the surface of the label mount 10, at the first curvature position P4. Subsequently, the support roller 43 contacts the surface on the lower side of the print-receiving tape 3A at the second curvature position P5. Subsequently, the aforementioned curved part 44 contacts the surface on the lower side of the print-receiving tape 3A, between the support roller 43 and the platen roller position P6. With the curved wall surface 42, the support roller 43, and the curved part 44 contacting the surface on the label mount side of the print-receiving tape 3A, the feeding path becomes curved in shape, causing the surface on the label mount side to become recessed in the tape longitudinal direction. That is, the curved surface 42, the support roller 43, and the curved part 44 contact the print-receiving tape 3A, pressing the label mount 10 to the separation sheet 3*c*. The print-receiving tape 3A is then fed while in such contact, thereby preventing the peeling of the label mount 10 from the separation sheet 3*c* on the feeding path.

Rib structure provided to mating part of upper cover main body and window member Subsequently, the structure of a rib member 72 provided to a mating part M of the upper cover main body 5A and the window member 5C will be described with reference to FIG. 1 and FIG. 17 to FIG. 23.

As illustrated in FIG. 1, the transparent window 5C that is made of a transparent resin and enables verification of the roll 3 housed in the interior of the housing 2 is provided to the upper cover main body 5A of the upper cover 5. This transparent window 5C is fixed via insertion into an opening 70 (refer to FIG. 18 and FIG. 19) formed on the upper cover main body 5A. With the insertion of the transparent window 5C, the mating part M formed between the window member 5C and the opening 70 comprises a front mating part Ma positioned in the front, a rear mating part Mb positioned in the rear, a left mating part Mc positioned on the left, and a right mating part Md positioned on the right. A gap sometimes occurs in this mating part M due to manufacturing errors, etc., of the window member 5C and the opening 70.

Figure 17:
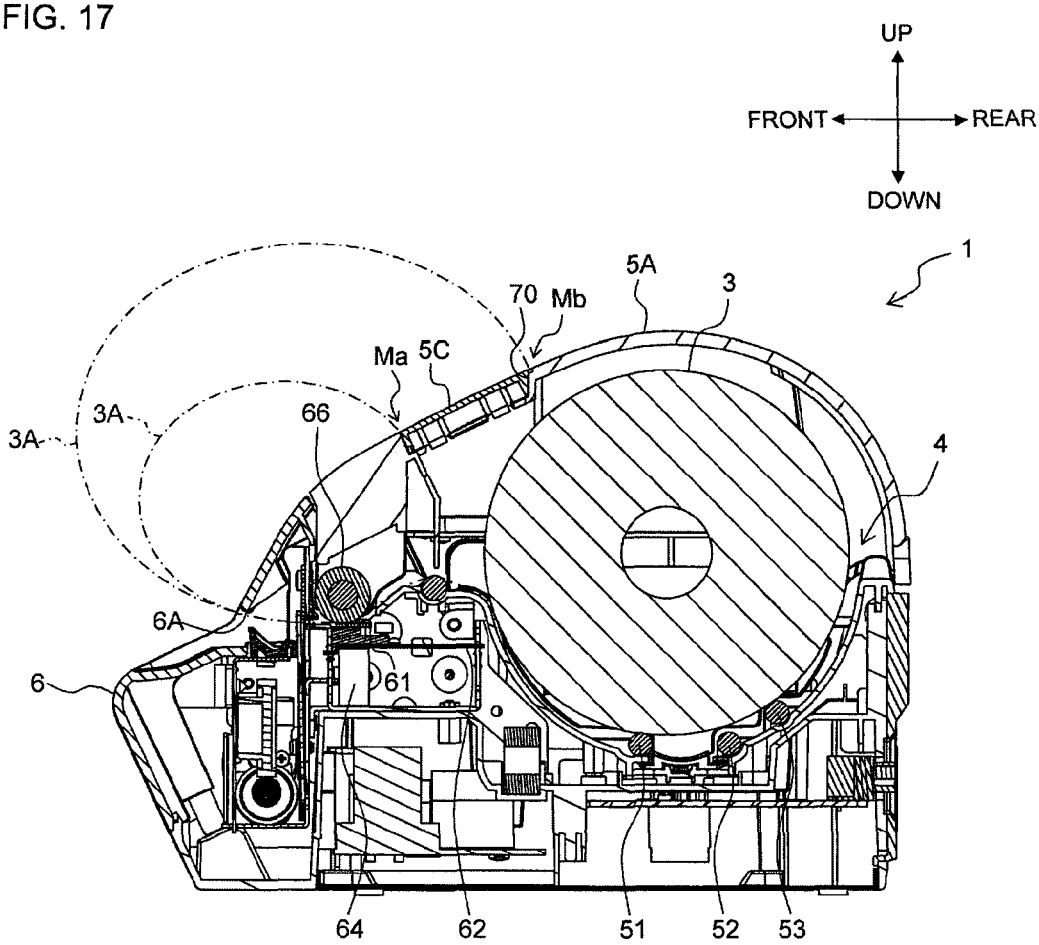
FIG. 17 is a side sectional view of the label producing apparatus showing the curved state of the discharged print-receiving tape.

Here, in a case of a configuration in which the print-receiving tape 3A is fed out from the lower side of the roll 3 as in this embodiment, the print-receiving tape 3A fed out from the discharging exit 6A sometimes curls upward as illustrated in FIG. 17 due to the effects of the winding direction of the roll 3. Further, in a case where a thermal head is used as the print head 61, such a curl sometimes occurs due to the effects of the heat therefrom. When such a curl occurs and the above-described gap exists in the mating part M of the opening 70 and the window member 5C, particularly in the front mating part Ma and the rear mating part Mb that are parallel with the tape width direction of the print-receiving tape 3A discharged from the discharging exit 6A, the front end of the print-receiving tape 3A may enter the gap, causing the print-receiving tape 3A to not discharge smoothly from the discharging exit 6A. In consequence, the rib member 72 is provided to the mating parts Ma and Mb in this embodiment, thereby preventing the print-receiving tape 3A from entering the gap as described above. A detailed description follows.

Figure 18:
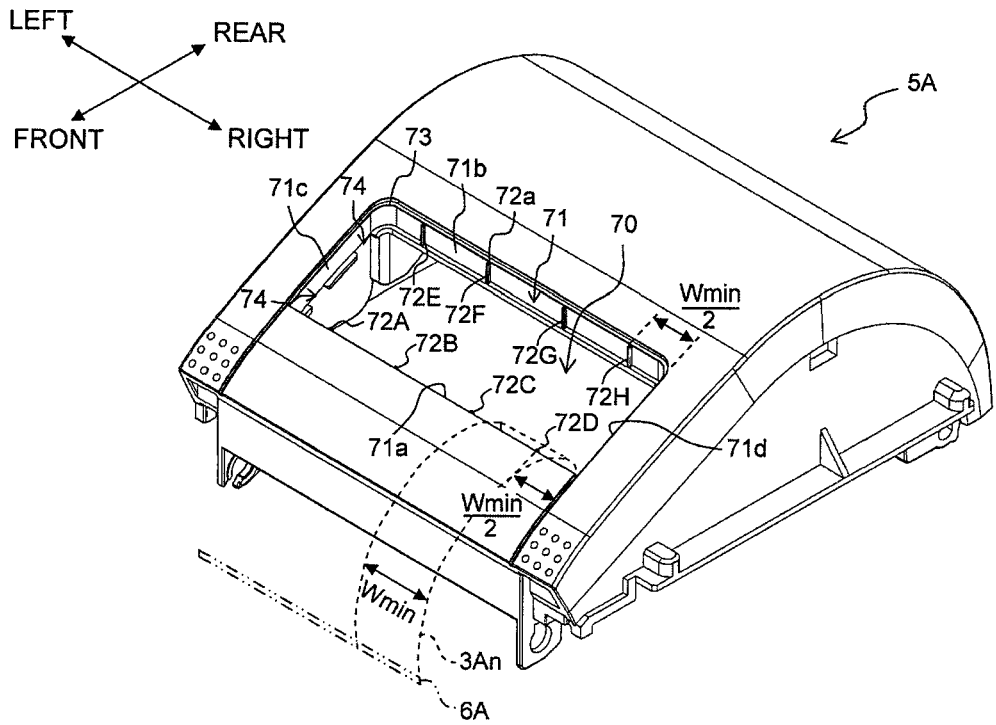
FIG. 18 is a perspective view of the upper cover main body with the window member removed, as viewed from the front.
Figure 19:
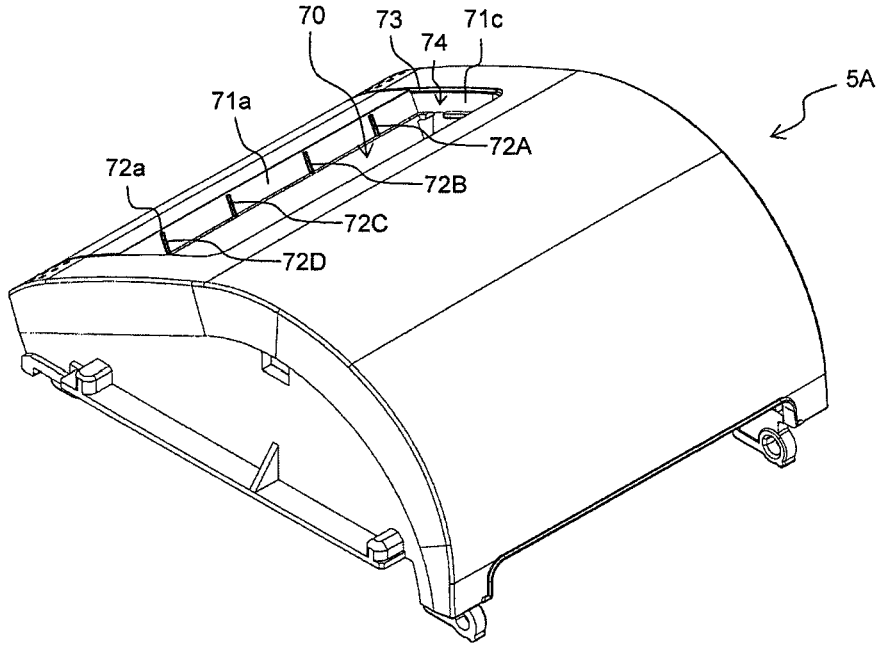
FIG. 19 is a perspective view of the upper cover main body with the window member removed, as viewed front the rear.

As illustrated in FIG. 18 and FIG. 19, an opening 70 is formed in a substantially rectangular shape, with inner side surfaces 71 thereof comprising a front inner side surface 71*a* positioned in the front, a rear inner side surface 71*b* positioned in the rear, a left inner side surface 71*c* positioned on the left, and a right inner side surface 71*d* positioned on the right. A plurality of rib members 72A to 72H (eight in this example) is provided in an extended condition to those inner side surfaces that are parallel with the tape width direction of the print-receiving tape 3A discharged from the discharging exit 6A, i.e., the front inner side surface 71*a* and the rear inner side surface 71*b* which are the inner side surfaces along the width direction of the apparatus, in the width direction of the label producing apparatus 1. These rib members 72A to 72H engage with a rib groove 82 (refer to FIG. 20 to FIG. 22), which is formed on the transparent window 5C, when the transparent window 5C is inserted into the opening 70. Note that while the eight rib members 72A to 72H are provided in this embodiment, any other number is acceptable.

Each of the rib members 72A to 72H extends along an engaging direction DR (refer to the arrow in FIG. 22) toward the opening 70 of the transparent window 5C, and is provided to the front inner side surface 71*a* and the rear inner side surface 71*b* so that an end part 72*a* on the cover front surface side thereof is positioned inside the opening 70 by a predetermined distance d3 (refer to FIG. 22) from the position of a front surface 5Aa of the upper cover main body 5A. According to the embodiment, this predetermined distance d3 is set to about 1 mm, for example. With the rib members 72A to 72H thus provided at positions inside the opening 70, the cover front end parts 72*a* of the rib members 72A to 72H are covered by the transparent window 5C when the transparent window 5C is inserted into the opening 70, thereby preventing the end parts 72*a* from being exposed on the cover front surface.

A step part 73 having a predetermined width is provided in series to the upper part of the rear inner side surface 71*b*, the left inner side surface 71*c*, and the right inner side surface 71*d* of the inner side surfaces 71 of the opening 70. This step part 73 forms a space Se (refer to FIG. 22) on the upper end part of the rear mating part Mb, the left mating part Mc, and the right mating part Md of the mating part M when the transparent window 5C is inserted into the opening 70. This space Se is used for inserting a predetermined jig when, for example, the transparent window 5C is to be removed from the opening 70. Note that the step part 73 is positioned within the opening 70 by the predetermined distance d3 from the front surface position of the cover main body 5A, and is equal in height with the cover front end part 72*a* of the rib members 72A to 72H on the rear inner side surface 71*b*.

A plurality of the rib members 72A to 72H (four in this example) are provided in parallel along the width direction of the label producing apparatus 1, on the front inner side surface 71*a* and the rear inner side surface 71*b*, respectively. The rib members 72D and 72H positioned on the far right in the apparatus width direction of the front inner side surface 71*a* and the rear inner side surface 71*b* are provided so that the positions correspond to the center in the tape width direction of a print receiving tape 3An having a minimum tape width. A detailed description follows. That is, while the roll housing part 4 is capable of housing the roll 3 of an arbitrary width through the advance and retreat of the guide member 20 as described above, the minimum roll width that is housed, that is, a minimum tape width Wmin of the print-receiving tape 3A discharged from the discharging exit 6A, is determined by the standards of the roll and print-receiving tape 3A (refer to FIG. 18).

Here, the label producing apparatus 1 is capable of producing a plurality of the printed labels L differing in width, using the roll 3 of an arbitrary width that is housed in the roll housing part 4. Accordingly, a plurality of the print-receiving tapes 3A of different tape widths is discharged from the discharging exit 6A. At this time, the discharging exit 6A discharges the plurality of print-receiving tapes 3A of different tape widths while orienting the tape right end positions thereof to the position of a discharging exit side wall 67 (refer to FIG. 1) at the right end of the discharging exit 6A in the apparatus width direction. The positions of the discharging exit side wall 67 and the right inner side surface 71*d* of the opening 70 are aligned in the apparatus width direction. Then, the right-most rib members 72D and 72H of the front inner side surface 71*a* and the rear inner side surface 71*b* , respectively, are provided to the position in the width direction that is a distance Wmin/2 from the right inner side surface 71*d* , as illustrated in FIG. 18. As a result, the positions of the above-described rib members 72D and 72H correspond to the center position in the tape width direction of the print-receiving tape 3An which has the minimum tape width Wmin and is discharged from the discharging exit 6A. Further, the rib members 72A to 72C and 72E to 72G other than the above-described right-most rib members 72D and 72H are disposed at a suitable interval corresponding to the other standard sizes of the roll 3 to be housed in the roll housing part 4.

Note that while the positions of the discharging exit side wall 67 and the right inner side surface 71*d* of the opening 70 align in the apparatus width direction in this embodiment, causing the right-most rib members 72D and 72H of the plurality of rib members 72A to 72H to align with the center position of the print-receiving tape 3An having a minimum tape width, the right end rib members 72D and 72H do not necessarily have to align. For example, in a case where the opening 70 is larger in the width direction than the discharging exit 6A, the middle rib member of the plurality of rib members 72A to 72H may be aligned to the center position of the print-receiving tape 3An having a minimum tape width. That is, the configuration is acceptable if at least one of the plurality of rib members 72A to 72H is aligned.

Figure 20:
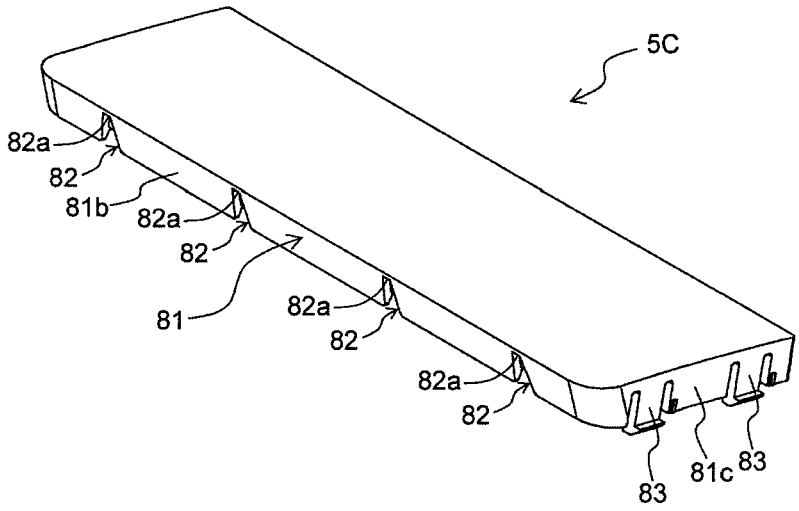
FIG. 20 is a perspective view of the transparent window, as viewed from the rear.
Figure 21:
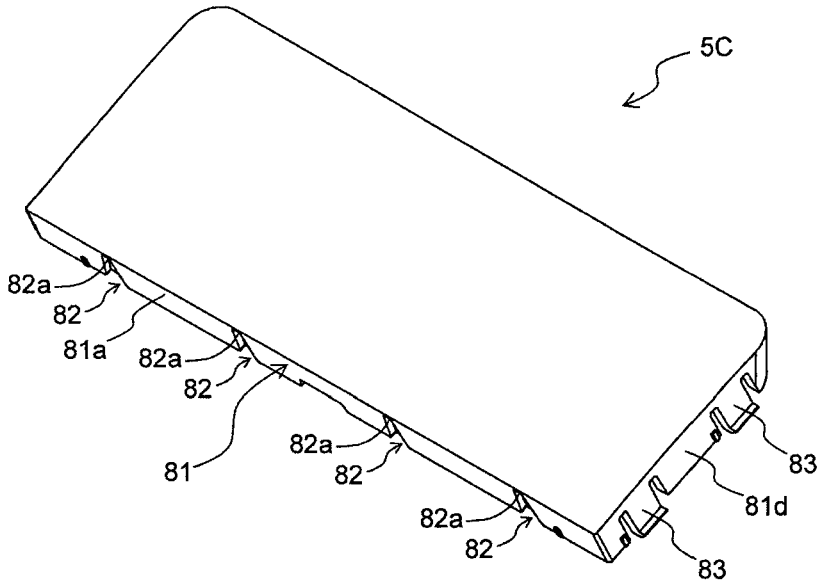
FIG. 21 is a perspective view of the transparent window, as viewed from the front.

As illustrated in FIG. 20 and FIG. 21, the transparent window 5C is formed into a substantially rectangular shape corresponding to the shape of the opening 70, and side surfaces 81 thereof comprise a front side surface 81*a* positioned in the front, a rear side surface 81*b* positioned in the rear, a left side surface 81*c* positioned on the left, and a right side surface 81*d* positioned on the right, when the transparent window 5C is inserted into the opening 70. The plurality of rib grooves 82 (eight in this example) to which the rib members 72A to 72H engage are provided to the front side surface 81*a* and the rear side surface 81*b* aligned with the front inner side surface 71*a* and the rear inner side surface 71*b* of the opening 70.

Each of the rib members 82 has a covering part 82*a* on the upper end part, which covers the corresponding cover front end part 72*a* of the rib members 72A to 72H when the transparent window 5C is inserted into the opening 70. Further, two locking tabs 83 are respectively provided on the left side surface 81*c* and the right side surface 81*d*. These locking tabs 83 lock to lock-receiving parts 74 provided to positions corresponding to the inner side surface 71 of the opening 70, thereby fixing the transparent window 5C to the opening 70.

Figure 22:
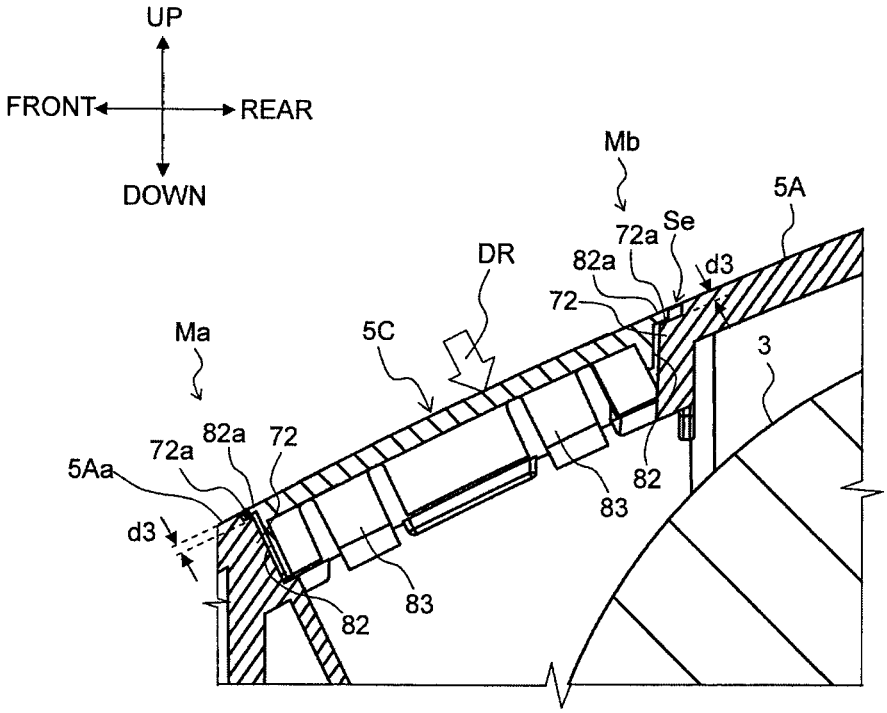
FIG. 22 is a sectional view of the rib member installation section of the engaging part of the transparent window and opening.
Figure 23:
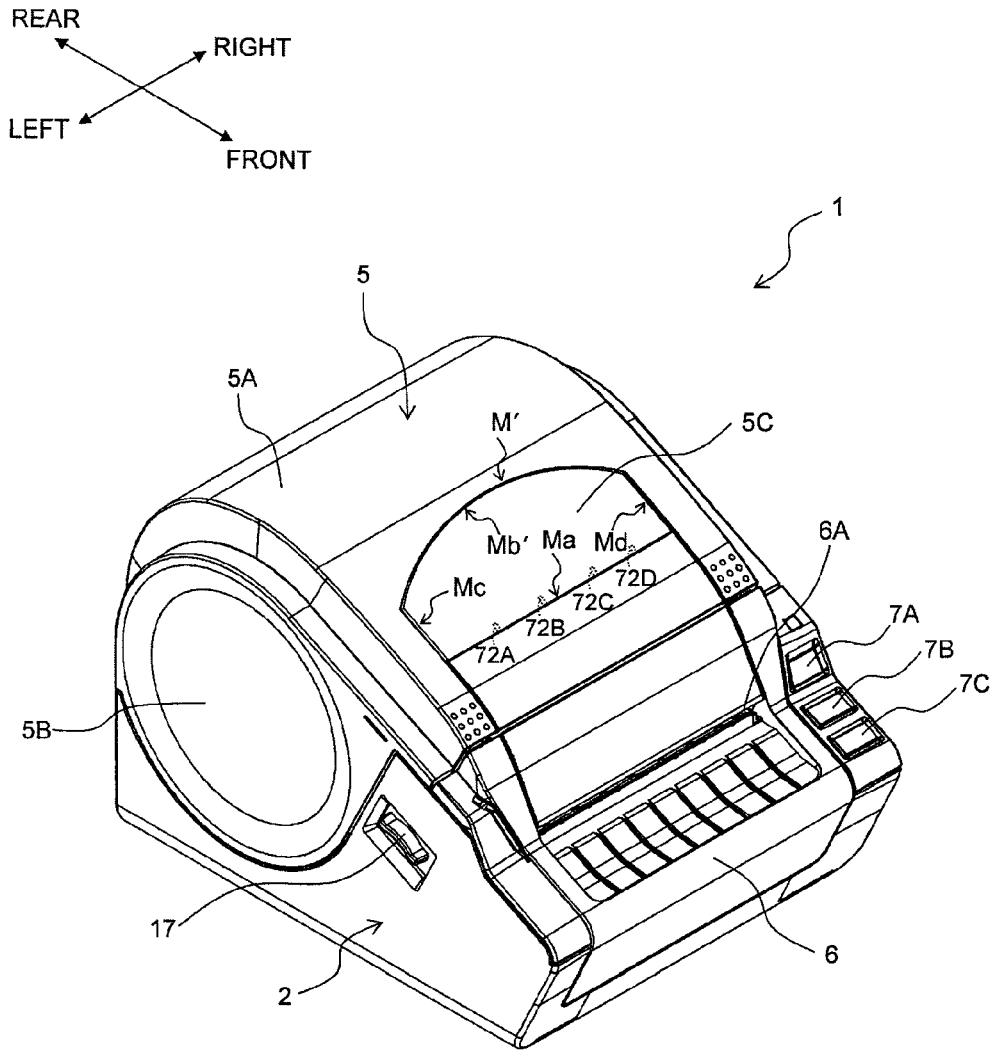
FIG. 23 is a perspective view illustrating the outer appearance of the label producing apparatus of the exemplary modification in which the mating part forms a curved line, as viewed from above from the front.

As illustrated in FIG. 22, when the transparent window 5C is inserted into the opening 70, the rib members 72A to 72H of the opening 70 engage with the rib grooves 82 of the transparent window 5C at the front mating part Ma and the rear mating part Mb. With this arrangement, even in the event a gap occurs at the mating parts Ma and Mb, the above-described gap is covered by the engaging of the rib members 72A to 72H with the rib grooves 82 of the transparent window 5C in the section where the rib members 72A to 72H are formed, thereby preventing the print-receiving tape 3A from entering that the gap area.

Note that the entering of the front end of the print-receiving tape 3A into the gap may also be prevented by forming the mating part M into a curved linear shape, in part or in whole, rather than providing the rib members 72A to 72H. For example, in the example shown in FIG. 23, the opening 70 and the transparent window 5C are formed so that a rear mating part Mb' of a mating part M' forms a fan shape that expands toward the rear. The other front mating part Ma, the left mating part Mc, and the right mating part Md are linear in shape, similar to those in FIG. 1. Then, the rib members 72A and 72D are provided to the front mating part Ma only, and the rib members 72 are not provided to the rear mating part Mb'.

With such a configuration, the rib members 72A to 72D prevent the front end of the print receiving tape 3A from entering the gap at the front mating part Ma of the mating part M'. Further, the rear mating part Mb' forms a curved line, making it possible to prevent the front end of the print-receiving tape 3A, which forms a straight line, from entering the gap, even when the rib members 72 are not provided. With this arrangement, it is possible to reliably prevent the front end of the print-receiving tape 3A from entering the gap. Additionally, providing the rear mating part Mb' makes it possible to decrease the number of rib members 72A to 72D, thereby simplifying the structure.

Note that the front mating part Ma may also form a curved line in addition to the rear mating part Mb'. In such a case, the rib members 72 are no longer required, thereby further simplifying the structure.

Function of Space Permitting Rise of Tape Piece

Subsequently, a tape piece rise permitting space Sp, which is formed near the discharging exit 6A in the interior space of the housing 2, will be described.

Figure 24:
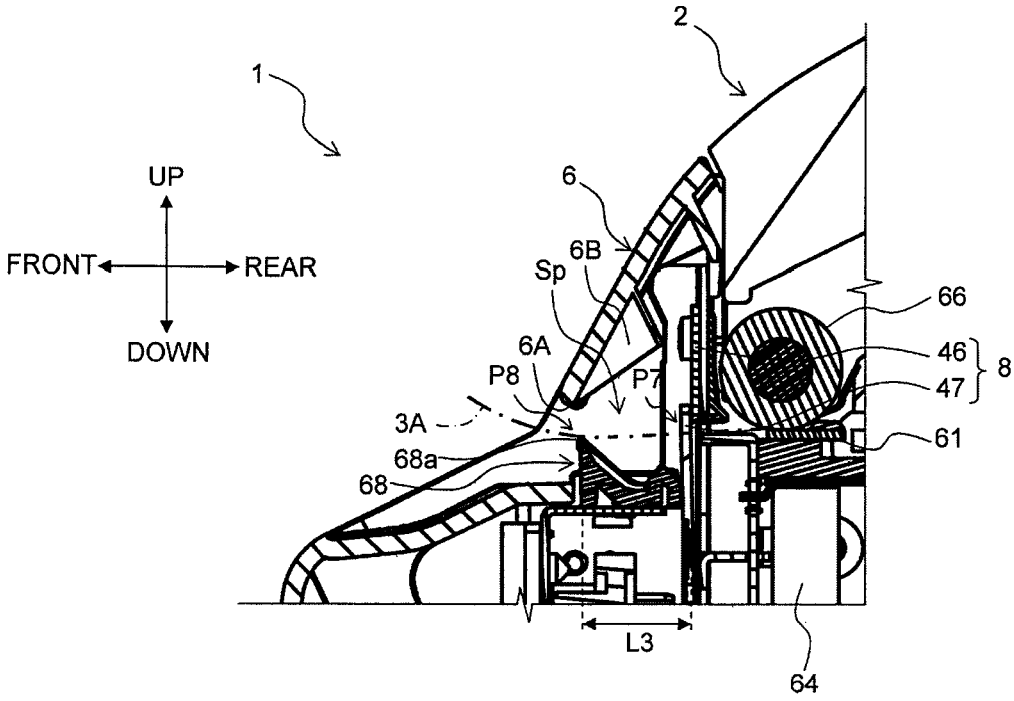
FIG. 24 is a side sectional view showing the internal structure near the discharging exit of the label producing apparatus.

The internal structure near the discharging exit 6A of the label producing apparatus 1 will now be described with reference to FIG. 24. The cutter unit 8 comprising the movable blade 47 and the fixed blade 46 is provided on the downstream side of the print head 61 and the platen roller 66 on the feeding path of the print-receiving tape 3A, as previously described. Further, a support member 68 is provided further downstream from the cutter unit 8. This support member 68 is pointed in a lateral view from one side of the apparatus in the width direction, comprises a support part 68*a* parallel to the tape width direction of the print-receiving tape 3A, and rotatably supports a tape piece 3Ap formed by cutting the print-receiving tape 3A after printing by the print head 61 to a predetermined length, with the support part 68*a* serving as the fulcrum in the lateral view, as illustrated in FIG. 25 described later. The tape piece 3Ap that rotates with the support part 68*a* serving as the fulcrum is discharged from the discharging exit 6A to the outside of the housing 2. The user peels the label mount 10 with print from the separation sheet 3*c* of the tape piece 3Ap and uses the label mount 10 as the printed label L.

At this time, in the housing 2, above the section on the feeding path of the print-receiving tape 3A, between the cutting position P7 of the cutter unit 8 and a support position P8 of the support member 68, is formed the tape piece rise permitting space Sp that permits rise of the downstream side of the tape piece 3Ap in the transport direction from the fulcrum, which occurs when the tape piece 3Ap rotates in a direction that causes the downstream side thereof in the transport direction to lower with the support part 68*a* serving as the fulcrum. The vertical region of this tape piece rise permitting space Sp is the space above the feeding path of the print-receiving tape 3A and below a structure member 6B provided to the inside of the front panel 6, and specifically is formed by cutting off a structure member (a rib, for example) of the structure member 6B that protrudes on the print-receiving tape 3A side.

Further, the support member 68 is provided so that a length L3 between the cutting position P7 and the support position P8 on the feeding path is equivalent to one-half of a minimum length Lmin of the tape piece 3Ap or less. Here, the minimum length Lmin is the length when only one of the label mounts 10 is disposed on the tape piece 3Ap formed by cutting. With this arrangement, the length of the tape piece 3Ap on the downstream side in the transport direction from the fulcrum is always longer than the length on the upstream side in the transport direction from the fulcrum (that is, the support point P8, which is the contact point with the support part 68*a*; hereinafter the same), when supported by the support member 68.

The permitting of the rise of the upstream side of the tape piece 3Ap in the transport direction from the fulcrum by the tape piece rise permitting space Sp when the tape piece 3Ap is discharged will now be described with reference to FIG. 25.

Figure 25A:
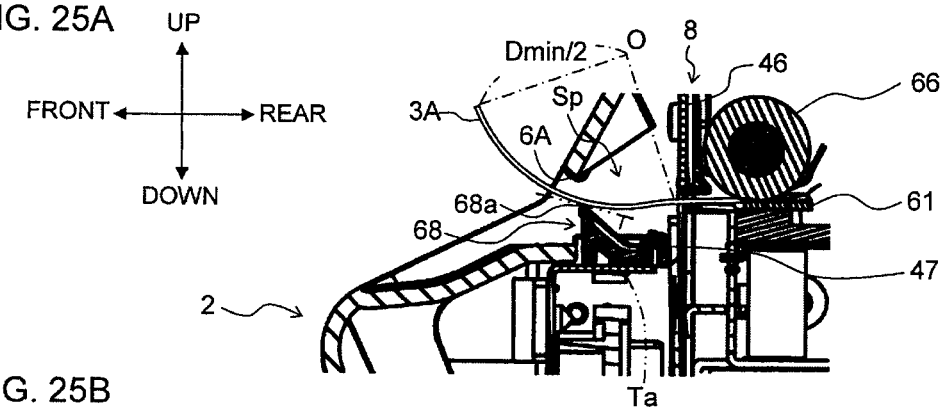
FIG. 25A is a diagram illustrating the tape piece rise permitting space permitting the rise of the upstream side of the tape piece in the transport direction, from the fulcrum of the tape piece, at the time of tape piece discharge.

As illustrated in FIG. 25A, the print-receiving tape 3A on which printing is printed by the print head 61 is fed by the platen roller 66 and discharged from the discharging exit 6A to the outside of the housing 2. At this time, the cutter unit 8 is in a state in which the movable blade 47 is lower than the fixed blade 46. Additionally, since the print-receiving tape 3A is fed out from the lower side of the roll 3 in this embodiment, the print-receiving tape 3A discharged from the discharging exit 6A curls into a fan shape with its end part on the downstream side in the transport direction (the left end part in the figure) facing upward, due to the effect of the direction of winding of the roll 3. Note that, in this example, the roll 3 is nearly almost completely used, that is, the roll outer diameter D is substantially equal to the minimum value Dmin (refer to FIG. 14C), and therefore the print-receiving tape 3A curls into a fan shape at a curvature equivalent to the winding curvature of the print-receiving tape 3A of the roll 3 when the roll outer diameter D is the minimum value Dmin. With this arrangement, the radius of curvature of the curled section of the print-receiving tape 3A is Dmin/2. Note that a tangent line Ta of the fulcrum of the curled section of the print-receiving tape 3A at this time inclines toward a direction in which the upstream side in the tape feeding direction (the right side in the figure) is below the horizontal level.

Figure 25B:
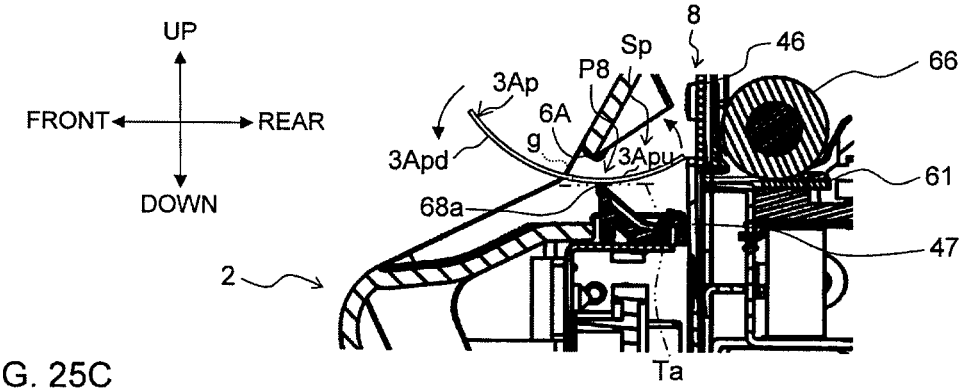
FIG. 25B is a diagram illustrating the tape piece rise permitting space permitting the rise of the upstream side of the tape piece in the transport direction, from the fulcrum of the tape piece, at the time of tape piece discharge.

Next, as illustrated in FIG. 25B, the movable blade 47 of the cutter unit 8 rises the moment the print-receiving tape 3A is discharged a predetermined distance, cutting the print-receiving tape 3A in coordination with the fixed blade 46. This particular example shows a case where the length of the tape piece 3Ap formed by cutting is equivalent to the minimum length Lmin. In consequence, when supported by the support member 68, the tape piece 3Ap is such that the length of the downstream side in the transport direction from the fulcrum (the left side in the figure) is longer than the length of the upstream side in the transport direction (the right side in the figure), causing a center of gravity g positioned at the center of both the width direction and transport direction of the tape piece 3Ap to be positioned further outward (to the left in the figure) than the support position P8. As a result, as illustrated in FIG. 25B, the tape piece 3Ap rotates in a direction that causes the downstream side thereof in the transport direction to lower with the support part 68*a* serving as the fulcrum, and the upstream side thereof in the transport direction to rise from the fulcrum. At this time, the tape piece rise permitting space Sp permits the rise of the upstream side of the tape piece 3Ap in the transport direction, from the fulcrum. Note that the tangent line Ta of the fulcrum of the tape piece 3Ap is substantially horizontal with the rotation of the tape piece 3Ap from the state shown in FIG. 25A described above. Further, the curvature of the tape piece 3Ap formed by cutting is equivalent to the curvature of the curled section of the print-receiving tape 3A shown in FIG. 25A.

Figure 25C:
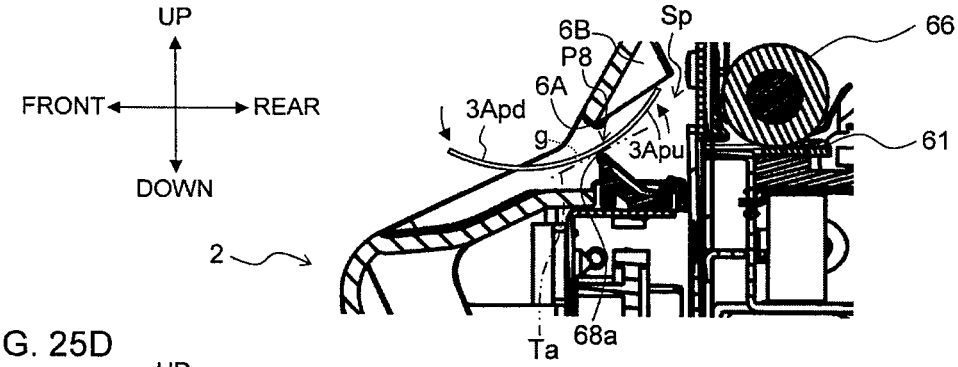
FIG. 25C is a diagram illustrating the tape piece rise permitting space permitting the rise of the upstream side of the tape piece in the transport direction, from the fulcrum of the tape piece, at the time of tape piece discharge.

Then, as illustrated in FIG. 25C, the tape piece 3Ap rotates with the support part 68*a* serving as the fulcrum until the upstream end part of the tape piece 3Ap in the transport direction contacts the lower end of the structure member 6B. When the upstream end part of the tape piece 3Ap in the transport direction contacts the lower end of the structure member 6B, the tape piece rise permitting space Sp permits the rise of the upstream side of the tape piece 3Ap in the transport direction to the maximum extent. At this time, the center of gravity g of the tape piece 3Ap is positioned further outward than the support position P8 and lower than the fulcrum. Further, the tangent line Ta of the fulcrum of the tape piece 3Ap at this time is inclined in the direction in which the downstream side in the tape feeding direction lowers with the rotation of the tape piece 3Ap from the horizontal state shown in FIG. 25B described above.

Figure 25D:
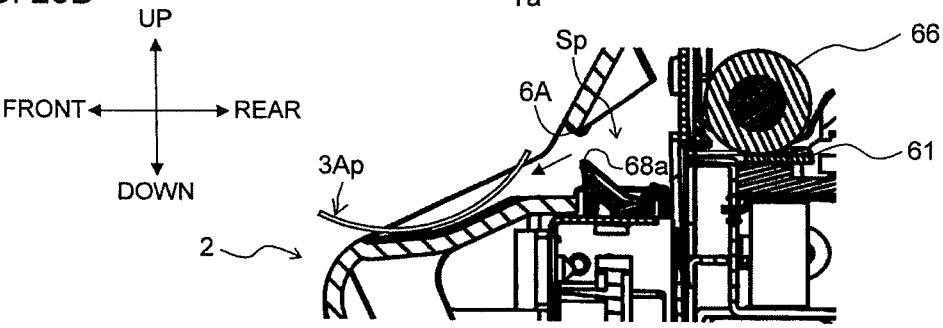
FIG. 25D is a diagram illustrating the tape piece rise permitting space permitting the rise of the upstream side of the tape piece in the transport direction, from the fulcrum of the tape piece, at the time of tape piece discharge.

Subsequently, with the center of gravity g of the tape piece 3Ap is positioned further outward than the support position P8 and lower than the fulcrum as described above, the lower surface slides against the support part 68*a* and the tape piece 3Ap discharges from the discharging exit 6A to the outside of the housing 2 as illustrated in FIG. 25D.

Note that the vertical dimension of the tape piece rise permitting space Sp is not necessarily required to the extent described above. That is, any vertical dimension is acceptable as long as the tape piece rise permitting space Sp permits the rise of the upstream side of the tape piece 3Ap in the transport direction to at least the state illustrated in FIG. 25B, that is, to a state in which the tangent line Ta of the fulcrum of the tape piece 3Ap is substantially horizontal. Such a state is required since, under such conditions, the center of gravity g is positioned further outward than the support position P8, making it possible to at least prevent the tape piece 3Ap from entering inside the housing 2 even if the tape piece 3Ap does not slide off the discharging exit 6A since the center of gravity g is positioned higher than the fulcrum.

Structure of Grasping Part of Guide Member

Subsequently, the structure of the grasping part 21A of the guide member 20 will be described.

As illustrated in the aforementioned FIG. 8 and FIG. 9, the grasping part 21A that is recessed in a direction in which the contact surface 25, which comes in contact with the roll 3 of the guide member 20, separates away from the roll 3, is provided to the main body 21 of the guide member 20. The grasping part 21A, owing to its recessed shape, forms a grasping space Sf that allows the user to catch and hold a finger between the guide member 20 and the end face 3L on the other side of the roll 3 in the width direction (on the left side in the width direction in this example) when advancing or retreating the guide member 20, as illustrated in the aforementioned FIG. 2. Note that the recessed shaped is formed from a position where the height from the lower end of the guide member 20 is H (refer to FIG. 26 described later), to the upper end of the guide member 20.

Additionally, as illustrated in FIG. 8 and FIG. 9, the grasping part 21A comprises a grip face GF curved in a direction away from the roll 3, within the above-described recessed shape. Then, the operation member 30 comprises the grip part 35 on the upper end part, that curves toward the same direction as the above-described grip face GF of the grasping part 21A, as illustrated in the aforementioned FIG. 6. With this arrangement, when the user operates the grip part 35 of the operation member 30 using one finger (the thumb, for example), the user catches and holds another finger (pointer finger or middle finger, for example) onto the grip face GF of the grasping part 21A of the guide member 20, thereby pinching the guide member 20 by the one finger and the other finger and thus making it possible to operate the operation member 30.

Figure 26:
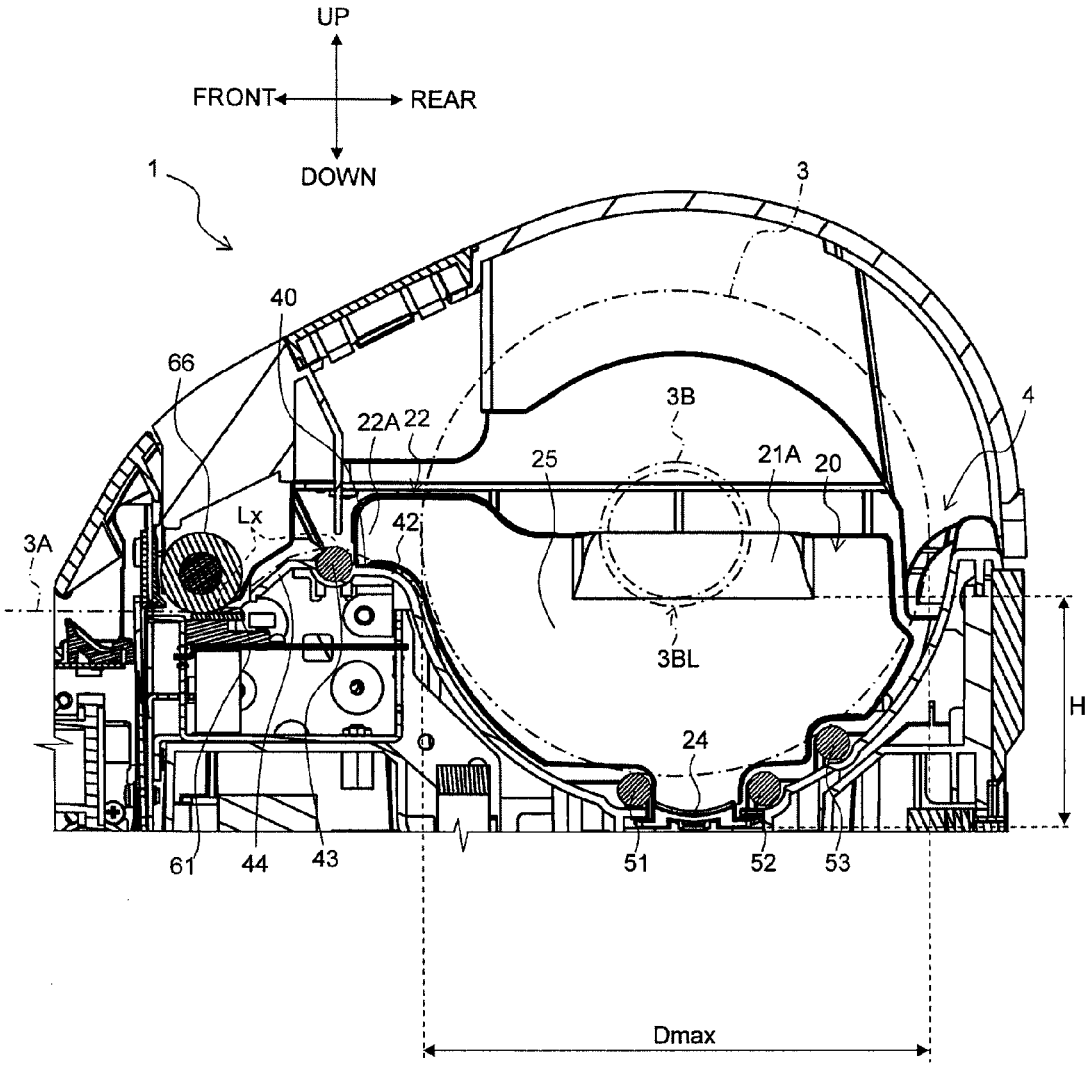
FIG. 26 is a side sectional view of the label producing apparatus showing the roll housed in the roll housing part when the roll outer diameter is the maximum value.

Subsequently, the height at which the grasping part 21A is formed will be described with reference to FIG. 26. In this example, the roll 3, which has a roll outer diameter D equivalent to the maximum value Dmax, is housed in the roll housing part 4. At this time, as illustrated in FIG. 26, the grasping part 21A is provided from a position of the aforementioned height H, which is a position higher than a lower end 3BL of the paper sleeve 3B when the roll outer diameter D is the maximum value Dmax, to the upper end of the guide member 20. Note that the height H is the height from the lower end of the guide member 20, that is, from the base part of the support part 24. With this arrangement, even when the height of the paper sleeve 3B is the maximum value, the contact surface 25 of the guide member 20 is capable of contacting the lower end 3BL of the paper sleeve 3B. Then, when the roll outer diameter D decreases and the height of the paper sleeve 3B lowers as the print-receiving tape 3A is fed out, the contact surface area of the contact surface 25 and the paper sleeve 3B can be further increased. That is, regardless of the size of the roll outer diameter D, the contact surface 25 is capable of reliably contacting at least a part of the paper sleeve 3B.

Structure of Sensor Holder

Subsequently, the structure of a sensor holder 90 provided to the feeding path of the print-receiving tape 3A will be described.

According to the label producing apparatus 1 of the embodiment, the print-receiving tape 3A is fed out and transported from the roll 3 housed in the roll housing part 4 by the platen roller 66, and then printing is performed on the print-receiving tape 3A by the print head 61, thereby forming the printed label L. At this time, an optical sensor 100 (refer to FIG. 27 described later) provided on the feeding path of the print-receiving tape 3A detects a predetermined reference position of the print-receiving tape 3A for printing control, such as the identification of the print start position by the print-head 61 with reference to the reference position. As illustrated in the aforementioned FIG. 2, FIG. 3, and FIG. 5, the optical sensor 100 is held near the tape surface of the print-receiving tape 3A by the sensor holder 90 provided on the upstream side of the print head 61 in the transport direction.

The detailed configuration of the sensor holder 90 will now be described with reference to FIG. 27. Note that, in FIG. 27A, peripheral members are omitted in order to show the positional relationship of the sensor holder 90.

Figure 27A:
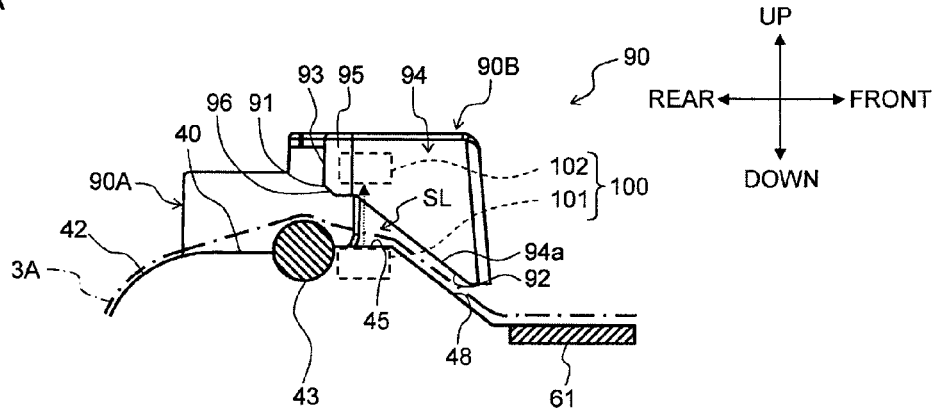
FIG. 27A is a side sectional view showing the detailed structure of the sensor holder.

As illustrated in FIG. 27A, the optical sensor 100 is provided between the support roller 43 and the print head 61 on the feeding path of the print-receiving tape 3A, and comprises a light-emitting part 101 and a light-receiving part 102. The light emitted by the light-emitting part 101 passes through the print-receiving tape 3A and is received by the light-receiving part 102. At this time, since the print-receiving tape 3A is designed with three layers comprised of the thermal layer 3*a*, the adhesive layer 3*b*, and the separation sheet 3*c* in the section where the label mount 10 is adhered, and a single layer of only the separation sheet 3*c* in the section where the label mount 10 is not adhered (the section between the label mounts 10) as described above, an end position 10A (refer to FIG. 4) of the label mount 10 in the transport direction is detected as the reference position based on the difference in the amount of light received by the light-receiving part 102, which is caused by a difference in thickness.

The light-emitting part 101 is provided to a horizontal surface 45 constituting the feeding surface of the print-receiving tape 3A, and the light-receiving part 102 is held to the upper part of the light-emitting part 101 by the sensor holder 90. At this time, the optical axis of the light-emitting part 101 matches the optical axis of the light-receiving part 102. Additionally, the sensor holder 90 also plays the roll of a cover that covers the light-receiving part 102. With the light-emitting part 101 disposed downward, the light-receiving part 102 disposed upward, and the entire light-receiving part 102 covered by the sensor holder 90, mistaken detection caused by ambient light is suppressed. Note that while the light-emitting part 101 and the light-receiving part 102 are disposed on both sides of the print-receiving tape 3A in this embodiment, a reflective-type sensor comprising both parts may be held by the sensor holder 90 on the upper side of the print-receiving tape 3A.

The sensor holder 90 is provided on an inclined section Lx (refer to FIG. 26) where the feeding path of the print-receiving tape 3A inclines downward, and comprises a support part 90A and an extended part 90B that extends a predetermined width in the tape width direction so that it covers a part of the upper surface of the print-receiving tape 3A. The extended part 90B forms a slit SL between the above-described horizontal surface 45 constituting the feeding surface of the print-receiving tape 3A, and an inclined surface 48 that inclines downward. This slit SL is open on both sides in the tape feeding direction (on both the left and right sides in FIG. 27), and on the left side in the tape width direction (toward the viewer of FIG. 27A). Note that the slit SL is blocked on the right side in the tape width direction (away from the viewer of FIG. 27A) by a guide member (not shown) provided on the feeding path. With such a configuration, the light-receiving part 102 of the optical sensor 100 is held by the sensor holder 90 near the tape surface of the print-receiving tape 3A inserted through the slit SL.

Note that the print-receiving tape 3A is inserted through the slit SL by inserting the end part of the print-receiving tape 3A via either an opening 91 upstream in the tape feeding direction (on the left side in FIG. 27A) or an opening 92 on the left side in the tape width direction (toward the viewer of FIG. 27A). That is, the front end part of the print-receiving tape 3A is inserted when the print-receiving tape 3A is inserted from the opening 91, and the right end part of the print-receiving tape 3A in the tape width direction is inserted when the print-receiving tape is inserted from the opening 92. Insertion of the print-receiving tape 3A through the slit SL is performed manually by the user when preparing to start printed label production, which is performed following a procedure such as follows.

That is, the user puts the roll 3 into the roll housing part 4 inside the housing 2 with the upper cover 5 open. Subsequently, the user feeds out the print-receiving tape 3A from the roll 3 to at least the position of the print head 61. At this time, the user inserts the print-receiving tape 3A into the slit SL of the sensor holder 90. Subsequently, the user closes the upper cover 5. With this arrangement, the print-receiving tape 3A is held by the platen roller 66 provided to the upper cover 5 side and the print head 61 provided to the housing 2 side, resulting in a state in which printing by the print head 61 and feeding of the print receiving tape 3A by the platen roller 66 are possible. Subsequently, the print-receiving tape 3A is fed a predetermined distance by the operation of the feed button 7C performed by the user, thereby starting production of the printed label L.

Figure 27B:
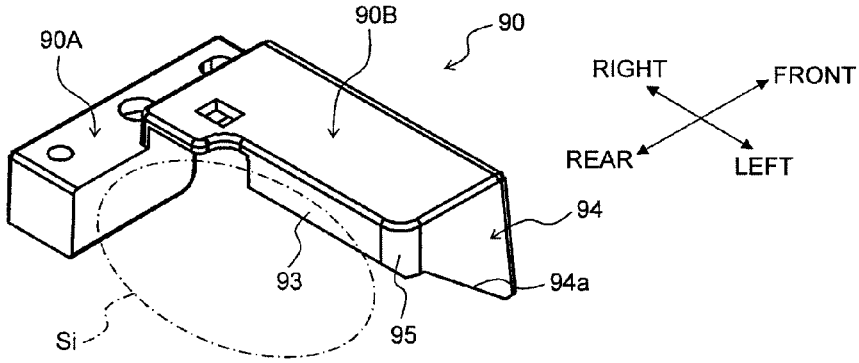
FIG. 27B is a perspective view showing the detailed structure of the sensor holder.
Figure 27C:
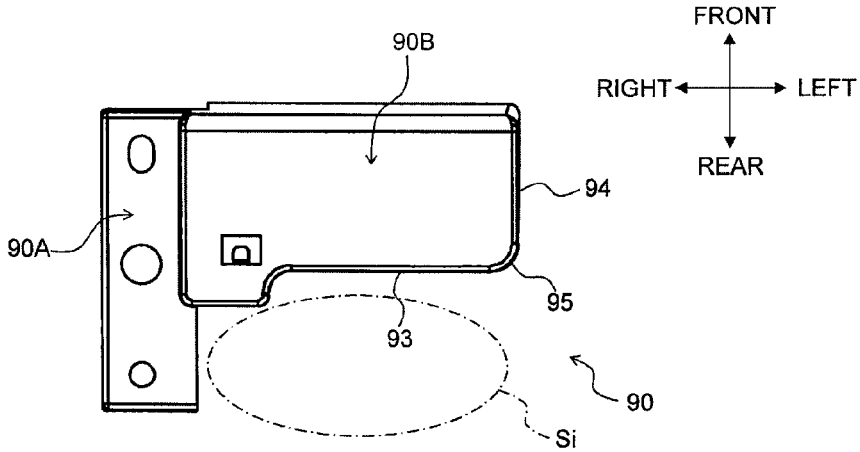
FIG. 27C is a top view showing the detailed structure of the sensor holder.

Further, as illustrated in FIG. 27A to FIG. 27C, a beveled part 95 is provided to a corner part of the extended part 90B of the sensor holder 90, that connects a side surface 93 on the upstream side in the tape feeding direction and a side surface 94 on the left side in the tape width direction. This beveled part 95 is formed into a curved surface shape. Additionally, as illustrated in FIG. 27A, a beveled part 96 is provided to a corner part (lower end part) of the extended part 90B of the sensor holder 90, on the slit SL side of the side surface 93 upstream in the tape feeding direction. With this beveled part 96, the inlet of the opening 91 on the upstream side of the slit SL in the tape feeding direction is widened.

Furthermore, as illustrated in FIG. 27B and FIG. 27C, the sensor holder 90 is formed into a substantial L-shape, in general. With this arrangement, a finger insertion space Si that allows the user to insert a finger tip when inserting the print-receiving tape 3A through the slit SL is formed in that L-shaped recessed section. With the finger insertion space Si, the user can insert his or her finger into the L-shaped recessed section, allowing the user to pinch the end part of the print-receiving tape 3A with his or her finger and easily insert it through the slit SL.

Further, as illustrated in FIG. 27A and FIG. 27B, the side surface 94 on the left side in the tape width direction comprises an inclined part 94*a* along the downward incline of the feeding path of the print-receiving tape 3A, on the lower end. With such a shape of the side surface 94, the slit SL formed between the extended part 90B of the sensor holder 90 and the horizontal surface 45 and the inclined surface 48 can be formed into a shape that follows along the inclined feeding path.

The label producing apparatus 1 of the above-described embodiment produces the printed label L by housing the roll 3 in the roll housing part 4 and printing desired print on the print-receiving tape 3A fed out from the roll 3. At this time, the fixed wall part 4A of the roll housing part 4 contacts the end face on the right side of the roll 3, and the guide member 20 contacts the end face on the left side of the roll. That is, the roll 3 is housed in the roll housing part 4 while inserted between the fixed wall part 4A and the guide member 20 and, in this state, the guide member 20 guides the width direction of the print-receiving tape 3A fed out from the roll 3.

Here, according to the embodiment, the guide member 20 is advance and retreat possible provided to the fixed wall part 4A, along the width direction of the roll 3. With this arrangement, the guide member 20 is advanced and retreated to adjust its position in accordance with the width of the housed roll 3, making it possible to insert the roll 3 of an arbitrary width between the fixed wall part 4A and the guide member 20 and guide the width direction of the print-receiving tape 3A. As a result, the roll 3 of an arbitrary width is supported.

Further, in a case where a roll with a guide member provided in advance to the roll side is used in a label producing apparatus without a guide member, for example, the guide member is discarded after use, resulting in a significant environmental load since guide members are generally made out of resin. In contrast, according to the embodiment, the guide member 20 is provided to the label producing apparatus 1, making it possible to eliminate the need for discard and reduce the environmental load.

Particularly, according to the environment, the operation member 30 is provided to the guide member 20. With this arrangement, the user operates the operation member 30 to unlock the guide member 20, thereby enabling advance and retreat of the guide member 20 and adjustment of the position of the guide member 20 in accordance with the roll width. Then, once the position is adjusted, the user operates the operation member 30 to lock the guide member 20, thereby fixing the guide member 20 to the position after adjustment. The user can thus easily switch the locked and unlocked state of the guide member 20 using the operation member 30, resulting in improved operability at the time of adjustment of the position of the guide member 20.

Further, particularly, according to the embodiment, when the user operates the operation member 30, the tab 34 provided to the lower end of the support part 32 of the operation member 30 and the groove part 13 provided to the base surface 4C of the roll housing part 4 disengage, unlocking the guide member 20. On the other hand, when the user stops operating the operation member 30, the tab 34 of the operation member 30 and the groove part 13 engage, locking the guide member 20. Thus, the locked state and the unlocked state of the guide member 20 can be reliably switched by switching the engaged and disengaged states of the tab 34 and the groove part 13 using the operation member 30.

Further, the guide member 20 is unlocked when the operation member 30 is in an operated state, and locked when the operation member 30 is in a non-operated state, causing the guide member 20 to be fixed during normal periods and movable only when necessary, such as at the time of roll replacement.

Furthermore, with the structure designed so that the tab 34 engages with one of the plurality of groove parts 13 provided to the roll 3 along the width direction on the base surface 4C of the roll housing part 4, the position of the guide member 20 can be adjusted in steps in accordance with the number of groove parts 13.

Further, particularly, according to the embodiment, when the user operates the operation member 30, the tab 23 of the extended part 22 of the guide member 20 and the groove part 41 provided to the flat surface 40 disengage, unlocking the guide member 20. On the other hand, when the user stops operating the operation member 30, the tab 23 and the groove part 41 engage, locking the guide member 20. Thus, the locked state and the unlocked state of the guide member 20 can be reliably switched by switching the engaged and disengaged states of the tab 23 and the groove part 41 using the operation member 30.

Further, with the structure designed so that the tab 23 provided to the front end of the extended part 22 of the guide member 20 engages with the groove part 41, the guide member 20 is capable of controlling the transport direction of the print-receiving tape 3A downstream in the feed-out direction, thereby increasing the guiding function provided by the guide member 20 to the print-receiving tape 3A.

Furthermore, according to the embodiment, the engaged and disengaged states of both the tab 34 of the operation member 30 and the groove part 13 provided to the roll housing part 4, and the tab 23 of the extended part 22 of the guide member 20 and the groove part 41 provided to the flat surface 40 are switchable, making it possible to provide support by the engaged states of the guide member 20 at two locations of the guide member 20, i.e., the base position and front end position in the tape feed-out direction, thereby securely fixing the guide member 20 in a locked state.

Further, according to the embodiment, when the user operates the operation member 30, the shaft member 60 slides in the front-back direction, extending in front of the guide member 20. Then, the front end of the shaft member 60 contacts the inclined surface of the roll housing part 4, lifting the front side of the guide member 20. As a result, the tab 23 provided to the extended part 22 of the guide member 20 and the groove part 41 provided to the flat surface 40 disengage, unlocking the guide member 20. On the other hand, when the user stops operating the operation member 30, the shaft member 60 slides, extending behind the guide member 20 and lowering the front side of the guide member 20. As a result, the tab 23 provided to the extended part 22 and the groove part 41 engage, holding the guide member 20 in a locked state.

With the structure thus designed so that the locked and unlocked state of the guide member 20 is switched via the shaft member 60, a structure that switches the locked and unlocked states of the guide member 20 by an operation performed by the user is achievable using a simple configuration without increasing the complexity of the structure.

Further, particularly, according to the embodiment, the guide member 20 further comprises the grasping part 21A that makes it possible for the user to catch and hold another finger on the guide member 20 when operating the operation member 30 with one finger. With this arrangement, when the user operates the operation member 30 with one finger, the user catches and holds another finger on the grasping part 21A of the guide member 20, enabling the user to operate the operation member 30 while pinching it between the one finger and the other finger. As a result, the operability at the time of adjustment of the position of the guide member 20 is further improved.

Further, particularly, according to the embodiment, the support part 24 that engages with the rail member 11 provided to the base surface 4C of the roll housing part 4 along the roll width direction via the engaging part 24A slides on the rail member 11, causing the guide member 20 to advance and retreat along the roll width direction. At this time, the eave members 12 that are provided above the support part 24 on both sides of the rail member 11 in the width direction and prevent separation of the support part 24 from the rail member 11 are disposed in a staggered manner along the width direction of the roll 3 on both sides of the width direction of the rail member 11. With this arrangement, separation of the support part 24 from the rail member 11 is prevented and the number of eave members 12 is decreased compared to that in a case of provision across the entire roll width direction, thereby decreasing the weight and reducing the cost of the label producing apparatus 1. Specifically, regardless of the advanced or retreated position of the support part 24, the eave members 12 are staggered so that three or more always overlap with the support part 24 in the vertical direction, making it possible to reliably prevent separation of the support part 24 from the rail member 11.

Further, in a case where the eave members 12 are intermittently disposed on both sides of the rail member 11 in the width direction, rather than staggered, so that the positions thereof in the roll width direction are the same, the support part 24 readily floats upward in the range where there are no eave members 12, causing the end part of the support part 24 and the end part of the eave members 12 to readily come in contact. Furthermore, since two of the eave members 12 on both sides in the width direction simultaneously contact the support part 24 at the same location in the roll width direction, the sliding of the support part 24 is not performed smoothly, deteriorating operability. Conversely, according to the embodiment, the eave members 12 are disposed in a staggered manner as described above, preventing the floating of the support part 24 and making it difficult for the end part of the support part 24 and the end part of the eave members 12 to contact each other. Furthermore, since two of the eave members 12 on both sides in the width direction do not simultaneously contact the support part 24 at the same location in the roll width direction, the sliding of the support part 24 is performed smoothly, improving operability.

Further, particularly, according to the embodiment, the flange parts 29 formed on both sides of the support part 24 in the width direction are designed so that the thickness L1 of the flange part 29R positioned on the rear side of the print-receiving tape 3A is thicker than the thickness L2 of the flange part 29F positioned on the front side. With this arrangement, of the flange parts 29 of the support part 24, it is possible to form a gap between the eave part 12 and the flange part 29F positioned on the front side that is greater than a gap between the eave part 12 and the flange part 29R positioned on the rear side. As a result, the lifting of the front side of the guide member 20 by the extension of the shaft member 60 is permitted.

Further, according the present embodiment, the following advantage can be achieved.

That is, in the embodiment, the fixed wall part 4A of the roll housing part 4 contacts the end face 3R on the right side of the roll in the width direction, causing the guide member 20 to advance and retreat with respect to the fixed wall part 4A in accordance with the width of the housed roll 3 as described above, making the guide member 20 contact the end face 3L on the left side of the roll 3 in the width direction. With this arrangement, the roll 3 is housed in the roll housing part 4 while inserted between the fixed wall part 4A and the guide member 20 and, in this state, the guide member 20 guides the width direction of the print-receiving tape 3A fed out from the roll 3. The advancing and retreating operation of the guide member 20 is performed by having the user catch and hold his or her finger onto the grasping part 21A of the guide member 20.

At this time, the grasping part 21A is provided to the guide member 20 so that the grasping space Sf, which enables the user to catch and hold his or her finger between the guide member 20 and the end face 3L on the left side of the roll 3 in the width direction, is formed. This grasping part 21A makes it possible to secure the grasping space Sf between the grasping part 21A and the end face 3L of the roll 3, regardless of the change in the outer diameter D of the roll 3 as the print-receiving tape 3A is fed out. With this arrangement, the user can easily advance and retreat the guide member 20, even in a case where the outer diameter D of the roll 3 is large.

Further, particularly, in the embodiment, the grasping part 21A is formed on the guide member 20 so that the contact surface 25 of the guide member 20 that contacts the roll 3 forms a recessed shape from the predetermined height H to the upper end. Such a shape of the grasping part 21A makes it possible for the grasping space Sf to be reliably formed from the predetermined height H to the upper end, between the guide member 20 and the roll end face 3L. In consequence, the user can catch and hold his or her finger on the grasping space Sf from above and easily advance and retreat the guide member 20.

Further, particularly, in the embodiment, the following advantage is achieved. That is, in the label producing apparatus 1, the roll 3 is housed in the housing part 4 while inserted between the fixed wall part 4A and the guide member 20. Then, the print-receiving tape 3A is fed out while the roll 3 rotates inside the roll housing part 4, gradually decreasing the roll outer diameter D from the maximum value to the minimum value as the print-receiving tape 3A is fed out.

Here, the roll 3 is formed by winding the print-receiving tape 3A into a roll shape around the paper sleeve 3B, which serves as the roll core. In a case where the paper sleeve section of the end face 3L on the left side of the roll 3 in the width direction is not pressed by the guide member 20 due to the general properties of such a roll configuration, the paper sleeve section extends toward the guide member 20 side by the rotation of the roll 3, resulting in the possibility of deformation of the end face 3R on the right side of the roll 3 in the width direction into a telescope shape.

Here, in the embodiment, the grasping part 21A is formed from the height H, which is a position higher than the lower end 3BL of the paper sleeve 3B when the roll outer diameter D is the maximum value Dmax, to the upper end of the guide member 20. That is, the grasping part 21A is formed higher than the lower end position of the paper sleeve 3B when the height of the paper sleeve 3B is highest. With this arrangement, the grasping part 21A can be positioned higher than the lower end position of the paper sleeve 3B, regardless of the size of the roll outer diameter D, making it possible for the contact surface 25 of the guide member 20 to reliably contact at least a part of the paper sleeve 3B. In consequence, the shape of the grasping part 21A makes it possible to well maintain the operability of the guide member 20 and prevent deformation of the roll 3 such as described above.

Further, particularly, in the embodiment, the grasping part 21A comprises the grip face GF that curves in the direction away from the roll 3, from the height H to the upper part of the guide member 20. With this arrangement, the grasping space Sf on which the user catches his or her finger when advancing and retreating the guide member 20 can be formed into an upward widening shape, making it possible for the user to easily insert his or her finger into the grasping space Sf from above and further improve operability. Further, the grip face GF that contacts the finger of the user is formed into a curved surface shape, resulting in the advantage of improved gripability as well.

Further, particularly, in the embodiment, the operation member 30 comprises the grip part 35 that curves in the same direction as the grip face GF of the grasping part 21A, on the upper end part. With this arrangement, when the user operates the operation member 30, the user catches one finger (the thumb, for example) on the grip part 35 on the upper end of the operation member and another finger (pointer finger, for example) on the grip face GF of the grasping part 21A of the guide member 20, allowing the user to operate the operation member 30 and extract and extend the guide member 20 while pinching the guide member (20) between the one finger and the other finger. As a result, user operability is further improved.

Further, according to the above-described embodiment, the following advantage can also be achieved.

That is, the platen roller 66 is rotationally driven, causing the print-receiving tape 3A to feed out from the roll 3 housed in the roll housing part 4 and be transported downstream while its width direction is guided by the guide surface 22A of the extended part 22 of the guide member 20. Then, desired printing is performed by the print head 61 to form the printed label L. At this time, the feeding path of the print-receiving tape 3A within the label producing apparatus 1 begins at feed-out positions F1, F2, and F3 where the print-receiving tape 3A is fed out from the roll 3, passes through the position of contact with the platen roller 66 and the position of printing by the print head 61, and arrives at the position of discharge by the discharging exit 6A. This feeding path changes in direction as the support roller 43, the curved wall surface 42, and the like provided on the feeding path come in contact with the print-receiving tape 3A, in accordance with the shape, arrangement, and the like of each device type and member constituting the label producing apparatus 1, thereby forming a suitably curved shape.

Here, the diameter of the roll 3 housed in the roll housing part 4 gradually decreases as the print-receiving tape 3A is fed out. As a result, the feed-out positions F1, F2, and F3 of the print-receiving tape 3A gradually move with the shrinking of the roll diameter, causing the feeding path of the print-receiving tape 3A immediately after roll feed-out to change in accordance with the roll diameter.

In the above-described embodiment, the guide surface 22A of the extended part 22 is provided on the feeding path of the print-receiving tape 3A, between the first curvature position P4 where the feeding path first curves after feed-out from the roll 3, and the platen roller position P6, as described above. At this time, the first curvature position P4 is the position where the feeding path of the print-receiving tape 3A fed out from the roll 3 first curves by contact with the curved wall surface 42, making the position of the feeding path of the print-receiving tape 3A at the first curvature position P4 constant. In consequence, even if the feeding path of the print-receiving tape 3A changes immediately after roll feed-out due to a change in the roll diameter as described above, the feeding path is limited from the feed-out positions F1, F2, and F3 to the first curvature position P4, and the feeding path downstream from the first curvature position P4 does not change. As a result, when the guide surface 22A is provided between the first curvature position P4 and the platen roller position P6 on the feeding path of the print-receiving tape 3A as described above, the print-receiving tape 3A is guided in the width direction in a section of the feeding path that is a set path regardless of the roll diameter. With this arrangement, the width direction of the print-receiving tape 3A is reliably guided.

Further, particularly, according to the embodiment, the guide surface 22A is provided between the first curvature position P4 and the second curvature position P5 on the feeding path of the print-receiving tape 3A. That is, the feeding path of the print-receiving tape 3A begins at the feed-out positions F1, F2, and F3 where the print-receiving tape 3A is fed out from the roll 3, curves at the two locations of the first curvature position P4 and the second curvature position P5, passes through the platen roller position P6 and the print position of the print head 61, and arrives at the discharge position. At this time, the transport direction of the print-receiving tape 3A fed out from the roll 3 forms a largely curved shape that resembles a mountain, with the first curvature position P4 and the second curvature position P5 substantially forming peaks. In consequence, the first curvature position P4 and the second curvature position P5 are provided so that they have a certain slope. As a result, the feeding path of the print-receiving tape forms an inclined surface having a certain slope in the section between the first curvature position P4 and the second curvature position P5, making it possible to install the guide surface 22A in a location that vertically guides the inclined surface. With this arrangement, the width direction of the print-receiving tape 3A is stably guided.

Further, particularly, according to the above-described embodiment, the support roller 43 that supports the print-receiving tape 3A is provided to the second curvature position P5. With this arrangement, the feeding path of the print-receiving tape 3A can largely curve at the second curvature position P5. Further, compared to a case where a curved wall surface contacts the print-receiving tape 3A causing the feeding path to curve, such as the first curvature position P4, the resistance caused by friction is largely reduced.

Further, particularly, according to the above-described embodiment, the guide member 20 comprises a structure that enables advance and retreat with respect to the fixed wall part 4A, along the width direction of the roll 3, making the guide surface 22A of the extended part 22 movable along the width direction of the print-receiving tape 3A as well. With this arrangement, it is possible to move the feeding guide member in accordance with the width of the print-receiving tape and adjust its position in the width direction. As a result, the width direction of the fed out print-receiving tape can be reliably guided for a plurality of rolls having different widths. Thus, rolls of various widths are supported.

Further, particularly, according to the above-described embodiment, the guide surface 22A of the extended part 22 and the main body 21 integrally constitute the guide member 20. With this arrangement, the width direction of the print-receiving tape 3A fed out from the roll 3 can be guided by a single member of the guide member 20 only. In consequence, compared to provision of two or more guide members, the number of parts is decreased, simplifying the structure. Further, both the main body 21 and the guide surface 22A of the extended part 22 can be adjusted by moving the guide member 20 and adjusting its position using the operation member 30. As a result, compared to a case where two guide members are provided, the width direction position can be easily adjusted.

Further, the following advantage can also be achieved.

That is, for example, in a case where there are two rollers having different peripheral direction positions with respect to the roll 3 inside the roll housing part 4, the roll 3 can be stably supported even if it has a large diameter by increasing the distance between the rollers, but problems arise such as the roll 3 falling off when the distance between the rollers is greater than the minimum value Dmin and the diameter of the roll 3 becomes smaller than the distance between the rollers. On the other hand, while the falling off of the above-described roll 3 can be prevented by making the distance between the two rollers smaller than the minimum value Dmin of the roll diameter, in such a case the problem arises that the roll 3 cannot be stably supported when the diameter of the roll 3 is large.

Here, in the above configuration, three rollers comprised of the first roller 51, the second roller 52, and the third roller 53 having different peripheral direction positions within the roll housing part 4 are provided, with the first roller 51 and the second roller 52 disposed horizontally, and the third roller 53 disposed higher than the first and second rollers 51 and 52. With this arrangement, the roll 3 is supported by the first roller 51 and the third roller 53 in the range in which the roll diameter decreases from the maximum value Dmax to just before the intermediate value Dmid, by the three rollers of the first roller 51, the second roller 53, and the third roller 52 when the roll diameter reaches the intermediate value Dmid, and by the first roller 51 and the second roller 52 in the range in which the roll diameter decreases from the intermediate value Dmid to the minimum value Dmin.

With the roller configuration for supporting the roll 3 thus differing according to the roll diameter, in the range from the maximum value Dmax to just before the intermediate value Dmid in which the roll diameter is relatively large, a large distance between the rollers can be achieved by supporting the roll 3 using the first roller 51 and the third roller 53, making stable support of the roll 3 possible. Further, in the range from the intermediate value Dmid to the minimum value Dmin in which the roll diameter is relatively small, the roll 3 is supported by the first roller 51 and the second roller 52 and the roller-to-roller distance d1 is set to a value smaller than the minimum value Dmin of the roll diameter, thereby preventing the roll 3 from falling off even when the roll diameter reaches the minimum value Dmin. In consequence, the roll 3 is stably supported regardless of the outer diameter D of the roll 3.

Furthermore, when the roll diameter reaches the intermediate value Dmid, the following advantage is achieved. That is, in general, when the platen roller 26 is rotationally driven, feeding out the print-receiving tape 3A from the roll 3, the load applied to tape feed-out, which is caused by roller friction and the inertia from the weight of the roll 3 itself, proportionately increases with the size of the roll diameter and the number of rollers supporting the roll 3. When this load increases beyond a predetermined value, the possibility exists that the print-receiving tape 3A will not be smoothly fed out from the roll 3, causing irregularity in the printing performed by the print head 61.

Conversely, in the above-described configuration, the three rollers of the first roller 51, the second roller 52, and the third roller 53 support the roll 3 when the roll diameter reaches the intermediate value Dmid, as described above. That is, when the number of rollers that support the roll 3 is the maximum number 3, the roll diameter is the intermediate value Dmid, which is significantly smaller than when the roll diameter is the maximum value Dmax. As a result, the load applied when the print-receiving tape 3A is fed out from the roll 3 is reduced, thereby suppressing the occurrence of print irregularities such as described above.

Further, particularly, in the above-described configuration, the three rollers 51 to 53 are disposed so that the roller-to-roller distance d1 between the first roller 51 and the second roller 52 is larger than the roller-to-roller distance d2 between the second roller 52 and the third roller 53. With this arrangement, in a case where the difference in height between the first and second rollers 51 and 52 and the third roller 53 is constant, the radius of curvature of the curved surface that contacts all three rollers—the first roller 51, the second roller 52, and the third roller 53—is smaller than a case where the roller-to-roller distance d1 and the roller-to-roller distance d2 are equal. As a result, when the number of rollers that support the roll 3 is the maximum three, the roll diameter can be reliably decreased, making it possible to reliably reduce the load when the print-receiving tape 3A is fed out from the roll 3.

Further, particularly, in the above configuration, the roll 3 used is a roll having a maximum value Dmax of the roll diameter (101.6 mm, for example) that is three times greater than the minimum value Dmin or more (29.4 mm for example). With this arrangement, stable support of the roll 3 is possible across a wide range in which the roll diameter decreases from the maximum value Dmax, which is three or more times greater than the minimum value Dmin, to the minimum value Dmin.

Further, the following advantage can also be achieved.

In the above-described configuration, the curved wall surface 42, the support roller 43, and the curved part 44 that contact the surface of the print-receiving tape 3A on the label mount side are provided on the feeding path of the print-receiving tape 3A. The curved wall surface 42, the support roller 43, and the curved part 44 contact the print-receiving tape 3A, pressing the label mount 10 to the separation sheet 3*c*. The print-receiving tape 3A is then transported while in such contact, thereby preventing the peeling of the label mount 10 from the separation sheet 3*c* on the feeding path. As a result of such contact, the print-receiving tape 3A having low adhesive strength with respect to the separation sheet 3*c* of the label mount 10 can be used, thereby expanding the application range of the print-receiving tape 3A.

Further, particularly, in the above-described configuration, the curved wall surface 42, the support roller 43, and the curved part 44 are provided on the feeding path of the print-receiving tape 3A, between the feed-out positions F1, F2, and F3 from the roll 3 and the platen roller position P6. With such a configuration, the contact pressure between the print-receiving tape 3A and the curved wall surface 42, the support roller 43, and the curved part 44 is highly maintained due to the pulling force caused by the platen roller 66, thereby reliably preventing peel-off of the label mount 10.

Further, particularly, in the above-described configuration, the roll 3 is formed by winding the print-receiving tape 3A so that the surface on the side of the label mount 10 is on the outside in the diameter direction. As a result, when the tape is fed out from the lower side of the roll 3, the print-receiving tape 3A is fed out with the surface on the side of the label mount 10 side positioned on the lower side. In consequence, the feeding path of the print-receiving tape 3A is curved by the curved wall surface 42, the support roller 43, and the curved part 44 provided to the lower side of the feeding path of the print-receiving tape 3A, causing the feeding path to curve so that the surface on the label mount 10 side of the print-receiving tape 3A recesses in the tape longitudinal direction, thereby reliably preventing peel-off of the label mount 10 from the separation sheet 3*c*.

Further, particularly, in the above-described configuration, the support roller 43 that supports the print-receiving tape 3A as a contact member is provided to the section where the feeding path of the print-receiving tape 3A is highest. With this arrangement, the feeding path of the print-receiving tape 3A is largely curved by the support roller 43, achieving a feeding path shaped like a mountain with the contact position with the support roller 43 forming a peak. Further, while the load applied to the print-receiving tape 3A increases due to the increased curvature of the feeding path at this location, use of the roller significantly decreases the resistance caused by friction and reduces the load applied to the print-receiving tape 3A, compared to the curvature of the feeding path upon contact with the curved wall surface 42, such as at the first curvature position P4. Furthermore, while the label mount 10 readily peels off when the print-receiving tape 3A contacts a wall surface due to the friction with the wall surface, use of the roller makes it possible to apply pressure while decreasing the friction and therefore reliably prevent peel-off of the label mount 10 from the separation sheet 3*c*.

Further, particularly, in the above-described configuration, use of the curved wall surface 42 curved in shape as the contact member at the first curvature position P4, which is a section where the amount of curvature of the feeding path is relatively small and the load on the print-receiving tape 3A is relatively low, simplifies the structure compared to a case where the support roller 43 is provided. Further, use of the contact members is suitably differentiated so that the contact member in the section where the feeding path is largely curved is the support roller 43, and the contact member in the section where the feeding path is minimally curved is the curved wall surface 42, thereby suppressing the load on the print-receiving tape 3A and forming the feeding path into a shape in accordance with the shape and layout of each device and member constituting the label producing apparatus 1.

Further, the following advantage can also be achieved.

The transparent window 5C is provided to the upper cover main body 5A, allowing verification of the amount of winding of the roll 3 housed within the housing 2, for example. This transparent window 5C is inserted into the opening 70 formed on the upper cover main body 5A. At this time, a gap sometimes occurs in the mating part M of the transparent window 5C and the opening 70 due to manufacturing errors and the like. Here, in the above-described configuration, the plurality of rib members 72 that engage with the rib grooves 82 formed on the transparent window 5C is provided to the inner side surfaces 71*a* and 71*b* of the inner side surfaces 71 of the opening 70 provided to the upper cover main body 5A, which are parallel with the tape width direction of the print-receiving tape 3A discharged from the discharging exit 6A. With this arrangement, even in a case where a gap occurs at the mating part M of the transparent window 5C and the opening 70 due to manufacturing errors or the like, the above-described gap is blocked by the engagement of the rib members 72 and the rib groove 82 of the transparent window 5C in the section where the rib members 72 are formed, thereby preventing the front end of the print-receiving tape 3A from entering the gap. As a result, smooth discharge of the print-receiving tape 3A is achieved.

Further, particularly, in the above-described configuration, the rib members 72 are provided to the inner side surfaces 71*a* and 71*b* of the opening 70 so that the end position of the cover front surface side of the rib members 72 is positioned inside of the opening 70 by the predetermined distance d3 from the front surface position of the upper cover main body 5A. With this arrangement, the cover front surface end part 72*a* of the rib members 72 is covered by the transparent window 5C, thereby preventing exposure of the cover front surface end part 72*a* of the rib members 72 on the front surface of the upper cover main body 5*a* and, in turn, a loss in the aesthetics of the label producing apparatus 1. Further, the predetermined distance d3 to the inside of the opening 70 is set to a small value of about 1 mm, thereby suppressing the depth to the rib members 72 in the gap that occurs at the mating part M of the transparent window 5C and the opening 70 to the small value. As a result, even if the front end of the print-receiving tape 3A enters the gap, the tape front end naturally exits the gap due to the pressure caused by tape discharge from the discharging exit 6A.

Further, in the above-described configuration, the label producing apparatus 1 further comprises the roll housing part 4 capable of housing the plurality of rolls 3 winding the print-receiving tapes 3A of varying tape widths, making it possible to produce a plurality of the printed labels L of varying widths using these rolls 3. Accordingly, the plurality of the print-receiving tapes 3A of different tape widths is discharged from the discharging exit 6A. The rib member 72 is provided in plurality in parallel with the apparatus width direction. With this arrangement, the positions and intervals thereof are suitably set, making it possible to prevent the tape front end from entering the gap even in a case where one of the print-receiving tapes 3A of a plurality of tape widths discharged from the discharging exit 6A curls upward.

Further, particularly, in the above-described configuration, the rib members 72D and 72H of the plurality of rib members 72A to 72H, which are farthest right in the apparatus width direction, are provided in positions corresponding to the center in the tape width direction of the print-receiving tape 3An, which has the smallest tape width and is discharged from the discharging exit 6A. With this arrangement, even when the discharged print-receiving tape 3A curls upward when the printed label L is produced using the print-receiving tape 3An, which has the smallest tape width, the right-most rib members 72D and 72H are positioned at the center of the print-receiving tape 3A in the tape width direction, thereby reliably preventing the front end of the print-receiving tape 3A from entering the gap. Further, the interval between the plurality of the rib members 72A to 72C and 72E to 72G other than the right-most rib members 72D and 72H is set to an appropriate value, preventing the front end from entering the gap even in a case where the print-receiving tape 3A of another tape width is used.

Further, in the above-described configuration, the print-receiving tape 3A is fed out from the lower side of the roll 3 housed in the roll housing part 4. When the configuration is thus designed so that the print-receiving tape 3A is fed out from the roll lower side, the print receiving tape 3A has a strong tendency to curl upward after discharge from the discharging exit 6A due to the effects of the direction of the winding of the roll 3. In consequence, in such a case, the aforementioned configuration makes it possible to more remarkably exhibit a function of preventing the front end of the print-receiving tape 3A from entering the gap.

Further, the following advantage can also be achieved.

In the above-described configuration, the print-receiving tape 3A is fed out and transported from the roll 3 by the platen roller 66, print is printed on the print-receiving tape 3A by the print head 61, and then the print-receiving tape 3A with print is cut at a predetermined length by the cutter unit 8. The tape piece 3Ap thus formed is rotatably supported by the support member 68 with the support part 68*a* serving as the fulcrum in a lateral view, and discharged to the outside of the housing 2 via the discharging exit 6A while rotating in a direction that causes the downstream side thereof in the transport direction to lower with the support part 68*a* serving as the fulcrum.

At this time, the tape piece rise permitting space Sp is formed above the section between the cutting position P7 and the support position P8 of the feeding path, inside the housing. This space permits the rise of the upstream side of the tape piece 3Ap in the feeding direction from the fulcrum when the tape piece 3Ap rotates toward a direction that causes the downstream side thereof in the transport direction to lower with the support part 68*a* serving as the fulcrum. With this arrangement, the tape piece 3Ap reliably rotates in a direction that causes the downstream side thereof in the transport direction to lower, with the support part 68*a* serving as the fulcrum, making smooth discharge of the tape piece 3Ap from the discharging exit 6A possible. As a result, problems such as clogging of the discharging exit 6A, entrance of the tape piece 3Ap into the housing, and double-cutting of the tape piece 3Ap that has entered the housing by the cutter motor 8 are prevented.

Further, particularly, in the above-described configuration, the tape piece rise permitting space Sp is formed so the upstream side thereof in the transport direction is permitted to rise, thereby permitting the tangent line Ta of the fulcrum of the tape piece 3Ap to at least become horizontal (horizontal or inclined in a direction in which the downstream side in the tape feeding direction is below from the horizontal level), when supported by the support member 68. That is, in a state in which the curled tape piece 3Ap is supported by the support member 68 and the tangent line Ta of the fulcrum of the tape piece 3Ap is inclined in a direction in which the downstream side in the tape feeding direction is below the horizontal level, the tape piece 3Ap rotates in a direction that causes the downstream side thereof in the transport direction to lower with the support part 68*a* serving as the fulcrum, thereby smoothly discharging the tape piece 3Ap from the discharging exit 6A. On the other hand, in a case where the tangent line Ta of the fulcrum of the tape piece 3Ap is inclined in a direction in which the upstream side in the tape feeding direction is below from the horizontal level, the possibility exists that the tape piece 3Ap may rotate in a direction that causes the upstream side thereof in the transport direction to lower with the support part 68*a* serving as the fulcrum, causing the tape piece 3Ap to not discharge smoothly from the discharging exit 6A, resulting in problems such as clogging of the discharging exit 6A and entrance of the tape piece 3Ap into the housing 2. In the above-described configuration, the tangent line Ta of the fulcrum of the tape piece 3Ap is at least horizontal, making it possible to prevent problems such as the clogging of the discharging exit 6A and the entrance of the tape piece 3Ap into the housing 2, as described above.

Further, in the above-described configuration, the following advantage is achieved. That is, in the label producing apparatus 1, the outer diameter D of the roll 3 housed in the roll housing part 4 gradually decreases from the maximum value Dmax to the minimum value Dmin as the print-receiving tape 3A is fed out. With this arrangement, the curvature of the curl of the tape piece 3Ap formed when the print-receiving tape 3A is cut by the cutter unit 8 most likely gradually increases since the winding curvature of the print-receiving tape 3A of the roll 3 gradually increases.

Here, to make the tangent line Ta of the fulcrum of the tape piece 3Ap horizontal when the tape piece 3Ap is supported by the support member 68, the tape piece rise permitting space Sp needs to be made larger in a case where the curvature of the tape piece 3Ap is large compared to a case where the curvature is small. Since a larger curvature results in a larger amount of curl of the tape piece 3Ap, the tangent line Ta cannot be made horizontal unless the upstream side in the transport direction of the tape piece 3Ap is significantly raised.

Here, in the above-described configuration, for the tape piece 3Ap that curls at a curvature equal to the winding curvature of the print-receiving tape 3A of the roll 3 when the roll outer diameter D is the minimum value, the upstream side thereof in the transport direction is permitted to rise owing to the tape piece rise permitting space Sp so that the tangent line Ta of the fulcrum of the tape piece 3Ap becomes at least horizontal. With this arrangement, even in a case where the curvature of the tape piece 3Ap is largest, the tangent line Ta of the fulcrum of the tape piece 3Ap can be made horizontal. In consequence, regardless of the change in the roll outer diameter D in association with the feed-out of the print-receiving tape 3A, problems such as clogging of the discharging exit 6A and entrance of the tape piece 3Ap into the housing 2 are prevented.

Further, particularly, according to the above-described configuration, the tape piece rise permitting space Sp permits the rise of the upstream side of the tape piece 3Ap in the transport direction when the tape piece 3Ap is supported by the support member 68 so that the center of gravity g of the tape piece 3Ap becomes lower than the fulcrum. With this arrangement, the center of gravity g of the tape piece 3Ap is positioned further downstream in the transport direction than the fulcrum, making it possible for the tape piece 3Ap to reliably rotate in a direction that causes the downstream side thereof in the transport direction to lower with the support part 68*a* serving as the fulcrum. As a result, the tape piece 3Ap smoothly discharges from the discharging exit 6A. Further, even if the rotation of the tape piece 3Ap is hindered by contact with the structure member 6B as in the above-described configuration, the center of gravity g of the tape piece 3Ap is lower than the fulcrum, making it possible to slide and smoothly discharge the tape piece 3Ap from the fulcrum.

Further, particularly, in the above-described configuration, the support member 68 is provided so that the length L3 between the cutting position P7 of the cutter unit 8 and the support position P8 on the feeding path is equivalent to half the minimum length Lmin of the tape piece 3Ap formed by the cutting by the cutter unit 8 or less. With this arrangement, when the tape piece 3Ap is supported by the support member 68, the length of the downstream side of the tape piece 3Ap in the transport direction from the fulcrum can be made longer than the length on the upstream side in the transport direction from the fulcrum. As a result, the center of gravity g of the tape piece 3Ap can be positioned further downstream in the transport direction than the fulcrum, making it possible for the tape piece 3Ap to reliably rotate in a direction that causes the downstream side thereof in the transport direction to lower with the support part 68*a* serving as the fulcrum. As a result, the tape piece 3Ap smoothly discharges from the discharging exit 6A.

Further, the following advantage can also be achieved.

That is, in the above-described configuration, the beveled part 95 is formed on the corner part between the side surface 94 on the left side in the tape width direction and the side surface 93 on the upstream side in the tape feeding direction of the sensor holder 90. With this arrangement, in a case where the right end part of the print-receiving tape 3A in the width direction is inserted from the opening 92 on the left side of the slit SL in the tape width direction, the amount of deformation (the amount of bending from the transport direction) of the print-receiving tape 3A when the corner part of the sensor holder 90 is inserted in an amount equivalent to the beveled section can be decreased, thereby facilitating guidance of the end part of the print-receiving tape 3A to the opening 92. In consequence, the user can easily insert the print-receiving tape 3A into the slit SL, making it possible to improve the user-friendliness of the label producing apparatus 1.

Further, particularly, in the above-described configuration, the beveled part 95 of the sensor holder 90 is formed into a curved surface shape. With this arrangement, the apex of the corner part between the side surface 93 and the side surface 94 is completely eliminated, making it possible to prevent problems such as catching of the print-receiving tape 3A at the apex. Further, with the corner part of the sensor holder 90 formed into a curved surface shape, the tape end readily moves between the two openings 91 and 92, making it possible for the user to easily switch between tape insertion from the opening 91 upstream in the tape feeding direction and tape insertion from the opening 92 on the left side in the tape width direction. Furthermore, when the user inserts the print-receiving tape 3A into the slit SL, accidents caused by contact of the user's forger with the corner part of the sensor holder 90 and the like can be prevented, thereby improving safety.

Further, particularly, in the above-described configuration, the beveled part 96 is formed on the corner part on the slit SL side of the side surface 93 on the upstream side of the sensor holder 90 in the tape feeding direction. With this arrangement, the inlet of the opening 91 on the upstream side of the slit SL in the tape feeding direction can be widened and problems such as the catching of the print-receiving tape 3A at the apex of the corner part can be prevented, thereby enabling the user to easily insert the front end of the print-receiving tape 3A into the slit SL from the opening 91. In consequence, the user-friendliness of the label producing apparatus 1 is further improved.

Further, particularly, in the above-described configuration, the sensor holder 90 further comprises the finger insertion space Si. With this arrangement, the user uses the finger insertion space Si to pinch and insert the end part of the print-receiving tape 3A with his or her fingers through the slit SL, thereby further improving the user-friendliness of the label producing apparatus 1.

Further, particularly, in the above-described configuration, the following advantage can also be achieved. That is, the print-receiving tape 3A withdrawn from the roll 3 sometimes curls due to the effects of the direction of winding of the roll 3. In such a case, even if the print-receiving tape 3A is fed out from the roll 3 to the print head 61 during the above-described preparation performed when starting label production, the print-receiving tape 3A does not reach the print head 61 due to the rising of the print-receiving tape 3A caused by the curl, resulting in the possibility that label production cannot be performed once the upper cover 5 is closed. In such a case, the user must open the upper cover 5 and redo the preparation once again after extending the curled print-receiving tape 3A.

In the above-described configuration, the sensor holder 90 is provided to the inclined section Lx where the feeding path of the print-receiving tape 3A inclines downward, and the side surface 94 on the left side of the sensor holder 90 in the tape width direction comprises the inclined part 93*a* along the inclined feeding path at the lower end. With such a shape of the side surface, the slit SL formed between the extended part 90B of the sensor holder 90 and the horizontal surface 45 and the inclined surface 48 can be formed into a shape that follows along the inclined feeding path. With this arrangement, when the user feeds the print-receiving tape 3A from the roll 3 to the print head 61, the user feeds the print-receiving tape 3A through the slit SL of the sensor holder 90, thereby pressing the print-receiving tape 3A fed through the slit SL along the inclined surface 48 and preventing the above-described floating of the print-receiving tape 3A. As a result, occurrence of such defects as described above is prevented, thereby further improving the user-friendliness of the label producing apparatus 1. Particularly, in the above-described configuration, in a case where the print-receiving tape 3A is fed out from the lower side of the roll 3, while the print-receiving tape 3A tends to curl upward due to the effects of the direction of winding of the roll 3, the print receiving tape 3A is pressed along a feeding path that is inclined downward as in the above-described configuration, making it possible to further increase the retention effect of the print-receiving tape 3A.

Further, the side surface 94 comprises the inclined part 94*a* , causing the sensor holder 90 to reliably cover the entire light-receiving part 102 of the optical sensor 100 while suppressing the gap with the feeding path. With this arrangement, the advantage of suppressing mistaken gap detection caused by ambient light is also achieved.

Note that various modifications may be made according to the present embodiment without departing from the spirit and scope of the disclosure, in addition to the above.

For example, while the above has been described in connection with an illustrative scenario in which the print-receiving tape 3A having the label mounts 10 disposed in series on the tape is used, the present disclosure is not limited thereto, allowing the present disclosure to be applied to configurations in which, for example, the printed label L is formed by printing print on a print-receiving tape on which a print-receiving tape layer (thermal layer or image-receiving layer) is formed and cutting the tape to a predetermined length. Further, while the above has described a method in which printing is performed on the print-receiving tape 3A (a so-called non-laminated method), the present disclosure may also be applied to a method where printing is performed on a cover film separate from the print-receiving tape 3A and then the two are bonded (a so-called laminated method).

Further, while the above has been described in connection with an illustrative scenario in which the print-receiving tape 3A is fed out from the lower side of the roll 3, the present disclosure is not limited thereto, allowing application to a case where the print-receiving tape 3A is fed out from the upper side of the roll 3. In such a case, a force acts on the roll 3, attempting to roll the roll 3 in the tape feed-out direction (toward the front in this example), making it best to dispose the third roller 53 on the feed-out direction side of the print-receiving tape 3A in contrast to the first and second rollers 51 and 52.

Further, in the above, while the support roller 43 is provided on the second curvature position P5, provision of the roller is not necessarily required, allowing the feeding path of the print-receiving tape 3A to curve by contact with a wall surface, similar to the first curvature position P4.

Further, while the above has been described in connection with an illustrative scenario in which the receiving mount (platen) of the print head 61 is the platen roller 66 of the feeding roller, the present disclosure is not limited thereto, allowing separate provision of a feeding roller that feeds out and transports the print-receiving tape 3A as the platen.

Additionally, other than those previously described, methods according to the above-described embodiment and modification examples may be utilized in combination as appropriate.

The label producing apparatus (1) of the embodiment comprises the roll housing part (4) that rotatably houses the roll (3) winding the print-receiving tape (3A) into a roll shape, the feeding roller (66) that feeds out and transport the print-receiving tape (3A) from the roll (3) housed in the roll housing part (4), a driving device for driving the feeding roller (66), printing device (61) for printing desired print on the print-receiving tape (3A) fed out from the roll (3) by the feeding of the feeding roller (66), and the three rollers (51, 52, and 53) having center axes of rotation that are parallel with the center axis of winding of the roll, wherein: the three rollers include at least two rollers that rotationally support the roll (3) and are dependently rotated by contact with the outer surface of the roll (3) when the driving device rotationally drives the feeding roller (66) causing the print-receiving tape (3A) to be withdrawn from the roll (3); and the three rollers comprise the first roller (51), the second roller (52), and the third roller (53) having different positions in the peripheral direction with respect to the roll (3), and are disposed so that the axis (51*a*) of the first roller (51) and the axis (52*a*) of the second roller (52) have a mutually horizontal positional relationship, and the axis (53*a*) of the third roller (53) is higher than the axis (51*a*) of the first roller (51) and the axis (52*a*) of the second roller (52) when installed to the installation surface (PR).

In the above-described label producing apparatus, the roll housing part (4) houses the roll (3) so that the print-receiving tape (3A) is fed out from the lower side of the roll (3), and the third roller (53) is disposed opposite the feed-out direction of the print-receiving tape (3A) from the first roller (51) and the second roller (52).

In the above-described label producing apparatus, the three rollers are disposed along the peripheral direction of the roll (3), in the order of the first roller (51), the second roller (52), and the third roller (53), and the first roller-to-roller distance (d1) between the axis (51*a* ) of the first roller (51) and the axis (52*a* ) of the second roller (52) is larger than the second roller-to-roller distance (d2) between the axis (52*a* ) of the second roller (52) and the axis (53*a* ) of the third roller (53).

In the above-described label producing apparatus, the roll housing part (4) houses the roll (3) having the outer diameter (D) that gradually decreases from the maximum value (Dmax) to the intermediate value (Dmid) and then to the minimum value (Dmin) as the print-receiving tape (3A) is fed out, and the three rollers are disposed in such a manner that the roll (3) is supported by the first roller (51) and the third roller (53) in the range in which the outer diameter (D) of the roll (3) decreases from the maximum value (Dmax) to just before the intermediate value (Dmid), and supported by the first roller (51), the second roller (52), and the third roller (53) when the outer diameter (D) of the roll (3) is the intermediate value (Dmid), and supported by the first roller (51) and the second roller (52) in the range in which the outer diameter (D) of the roll (3) decreases from the intermediate value (Dmid) to the minimum value (Dmin).

In the above-described label producing apparatus, the maximum value (Dmax) of the outer diameter (D) of the roll (3) is three times greater than the minimum value (Dmin) or larger.

The label producing apparatus (1) of the embodiment that produces printed labels (L) comprises the roll housing part (4) that rotatably houses the roll (3) winding the print-receiving tape (3A) in a roll shape wherein the plurality of label mounts (10) separated with each other in advance to a predetermined size in accordance with the printed label (L) to be produced is disposed in series on one surface of the separation sheet (3*c*) along the tape longitudinal direction, the feeding roller (66) that feeds out and transport the print-receiving tape (3A) from the roll (3) housed in the roll housing part (4), the printing device (61) for printing desired print on the label mounts (10) of the print-receiving tape (3A) fed out from the roll (3) by the feeding of the feeding roller (66), and at least one of the contact members (42, 43, 44) that are provided on the feeding path of the print-receiving tape (3A) and curve the feeding path by contacting the surface on the side of the label mounts (10) of the print-receiving tape (3A) so that surface of the label mounts (10) becomes recessed along the tape longitudinal direction.

In the above-described label producing apparatus, the contact members (42, 43, 44) are provided on the feeding path of the print-receiving tape (3A), between the feed-out positions (F1, F2, F3) from the roll (3), and the feeding roller position (P6) where the feeding roller (66) and print-receiving tape (3A) come in contact.

In the above-described label producing apparatus, the roll (3) winds the print-receiving tape (3A) so that the surface on the side of the label mounts (10) is on the outside along the diameter direction.

In the label producing apparatus, the roll housing part (4) houses the roll (3) so that the print-receiving tape (3A) is fed out from the lower side of the roll (3).

In the above-described label producing apparatus, the contact members includes the support roller (43) that supports the print-receiving tape (3A) by being dependently rotated, the support roller (43) provided to a section where the feeding path of the print-receiving tape (3A) is highest.

In the above-described label producing apparatus, the contact members includes the curved wall surface (42) that contacts the print-receiving tape (3A) on the feeding path of the print-receiving tape (3A).

The label producing apparatus (1) of the embodiment comprises the housing (2), the feeding roller (66) that feeds out and transports the print-receiving tape (3A) from the roll (3) winding the print-receiving tape (3A) in a roll shape, the printing device (61) that prints desired print on the print-receiving tape (3A) fed out from the roll (3) by the feeding of the feeding roller (66), the upper cover (5) that is provided to the upper part of the housing (2) and comprises the opening (70), the window member (5C) that is inserted into the opening (70), the discharging exit (6A) that is provided to the housing (2) and discharges the print-receiving tape (3A) to the outside of the housing (2), and at least one rib member (72) that is provided in an protrusion condition to the surfaces (71*a*, 71*b*) among the inner side surfaces (71) of the opening (70), the surfaces (71*a*, 71*b*) being parallel with the tape width direction of the print-receiving tape (3A) discharged from the discharging exit (6A), and the rib member (72) engages with the rib grooves (82) formed on the window member (5C) when the window member (5C) is inserted into the opening (70).

In the above-described label producing apparatus, the rib member (72) extends along the engaging direction (DR) of the opening (70) of the window member (5C), and is provided to the inner side surface (71) of the opening (70) so that the end part (72*a* ) on the cover front surface side of the rib member (72) is positioned inside the opening (70) at a predetermined distance from the front surface (5Aa) of the upper cover (5A).

In the label producing apparatus, a plural of the rib member (72) are provided in parallel with each other with respect to the width direction of the label producing apparatus (1) on the inner side surface (71) of the opening (70).

In the label producing apparatus, the label producing apparatus (1) further comprises the roll housing part (4) capable of housing selectively one of a plurality of the rolls (3), the rolls (3) respectively winding around the print-receiving tapes (3A) having different tape widths with each other, wherein: the discharging exit (6A) discharges one of the plurality of print-receiving tapes (3A) having the different tape widths while aligning the tape end part (3AR) of any of the print-receiving tape (3A) to the position of the end part (67) on one side of the discharging exit (6A) along the width direction of the label producing apparatus; and the plurality of rib members (72A-H) are provided to the inner side surface of the opening (70) so that at least one of the rib members (72D, 72H) is positioned in a location that corresponds to the center position of the print-receiving tape (3An) along the tape width direction, the print-receiving tape having the minimum tape width and discharged from the discharging exit (6A).

In the above-described label producing apparatus, the opening (70) and the window member (5C) are configured so that, when the window member (5C) is inserted into the opening (70), the mating part (M'), which is formed by the inner side surface (71) of the opening (70) and the side surface of the window member (5C), comprises the curved line part (Mb') and the straight line parts (Ma, Mc, Md), and the rib members (72A, 72B, 72C, 72D) are provided to the inner side surface (71) corresponding to the straight line parts (Ma, Mc, Md) and not to the inner side surface (71) corresponding to the curved line part (Mb').

In the above-described label producing apparatus, the roll housing part (4) houses the roll (3) so that the print-receiving tape (3A) is fed out from the lower side of the roll (3).

The label producing apparatus (1) of the embodiment comprises the housing (2), the feeding roller (66) that feeds out and transports the print-receiving tape (3A) from the roll (3) winding the print-receiving tape (3A) into a roll shape, the printing device (61) that prints desired print onto the print-receiving tape (3A) fed out from the roll (3) by the feeding of the feeding roller (66), the cutting device (8) that cuts the print-receiving tape (3A) with print at a predetermined length, the support member (68) that has the support part (68*a*) parallel with the tape width direction of the tape piece (3Ap) formed upon cutting the print-receiving tape (3A) and rotatably supports the tape piece (3Ap) around the support part (68*a*) as a fulcrum in a side view, and the discharging exit (6A) for discharging to the outside of the housing (2) the tape piece (3Ap) that rotates along a direction that causes the downstream side portion of the tape piece (3Aa) along the transport direction to lower with the support part (68*a*) serving as the fulcrum, wherein: the tape piece rise permitting space (Sp) that permits the rise of the upstream side (3Apu) of the tape piece (3Ap) along the transport direction from the fulcrum (68*a*), which is caused by the tape piece (3Ap) rotating along a direction that causes the downstream side (3Apd) of the tape piece (3Ap) along the transport direction to lower with the support part (68*a*) serving as the fulcrum, is formed in the housing (2) above the section between the cutting position (P7) and the support position (P8) on the feeding path of the print-receiving tape (3A) that begins from the feeding out position (F1, F2, F3) of the roll (3), passes through the cutting position (P7) of the cutting device (8) and the support position (P8) of the support member (68), and reaches the discharging exit (6A).

In the above-described label producing apparatus, the tape piece (3Ap) curls into a fan shape in which the end part of the downstream side (3Apd) of the tape piece (3Ap) along the transport direction faces upward when cut by the cutting device (8), and the tape piece rise permitting space (Sp) permits the rise of the upstream side (3Apu) along the transport direction of the tape piece (3Ap), making it possible for the tangent line (Ta) of the tape piece (3Ap) at the fulcrum (68*a* ) to become at least horizontal when the tape piece (3Ap) is supported by the support member (68).

In the above-described label producing apparatus, the roll housing part (4) houses the roll (3) in which the roll outer diameter (D) gradually decreases from the maximum value (Dmax) to the minimum value (Dmin) as the print-receiving tape (3A) is fed out, and the tape piece rise permitting space (Sp) permits the rise of the upstream side (3Apu) of the tape piece (3Ap) along the transport direction, thereby making it possible for the tangent line (Ta) of the tape piece (3Ap) at the fulcrum (68*a* ) to at least become horizontal at the condition that the tape piece (3Ap) curled at a curvature equivalent to the winding curvature of the print-receiving tape (3A) of the roll (3) when the roll outer diameter (D) is the minimum value (Dmin) is supported by the support member (68).

In the above-described label producing apparatus, the tape piece rise permitting space (Sp) permits the rise of the upstream side (3Apu) of the tape piece (3Ap) along the transport direction so that the center of gravity (g) of the tape piece (3Ap) becomes lower than the fulcrum (68*a* ) when the curled tape piece (3Ap) is supported by the support member (68).

In the above-described label producing apparatus, the support member (68) is provided so that the length (L3) between the cutting position (P7) and the support position (P8) on the feeding path is equivalent to half the minimum length (Lmin) of the tape piece (3Ap) formed by the cutting by the cutting device (8) or less.

The label producing apparatus (1) of the embodiment comprises the roll housing part (4) that houses the roll (3) winding the print-receiving tape (3A) into a roll shape, the feeding roller (66) that feeds out and transports the print-receiving tape (3A) from the roll (3) housed in the roll housing part (4), the printing device (61) that prints desired print on the print-receiving tape (3A) fed out from the roll (3) by the feeding of the feeding roller (66), the sensor device (100) that is provided on the feeding path of the print-receiving tape (3A) and detects the predetermined reference position (10A) of the print-receiving tape (3A) in order to control the printing by the printing device (61), and the sensor holder (90) that forms between the feeding surfaces (45, 48) for the print-receiving tape (3A) the slit (SL) that is open on both sides along the tape feeding direction and on one side along the tape width direction, and holds the sensor device (100) near the tape surface of the print-receiving tape (3A) inserted through the slit (SL), wherein the beveled part (95) is formed on the corner part where the side surface (93) of the sensor holder (90) upstream along the tape feeding direction and the side surface (94) of the sensor holder (90) on one side along the tape width direction are connected with each other.

In the above-described label producing apparatus, the beveled part (95) is formed into a curved surface shape.

In the above-described label producing apparatus, the beveled part (96) is formed on the lower end on the side of the slit (SL) of the side surface (93) of the sensor holder (90), upstream along the tape feeding direction.

In the above-described label producing apparatus, the sensor holder (90) comprises the finger insertion space (Si) that enables insertion of the tip of a finger when the user inserts the print-receiving tape (3A) through the slit (SL).

In the above-described label producing apparatus, the sensor holder (90) is provided on the inclined section (Lx) where the feeding path of the print-receiving tape (3A) inclines downward upstream from the printing device (61) along the transport direction, and the side surface (94) on one side of the sensor holder (90) along the tape width direction comprises the inclined part (94*a* ) along the downward incline of the feeding path on the lower end.

What is claimed is:

1. A label producing apparatus comprising:

a roll housing part that houses a roll around which a print-receiving tape is wound into a roll shape;

a feeding roller that feeds out and transports said print-receiving tape from said roll housed in said roll housing part;

a printing device that prints desired print on said print-receiving tape fed out from said roll by the feeding of said feeding roller; and a guide device that guides said print-receiving tape fed out from said roll housed in said roll housing part; wherein:

said guide device comprises either a first guide part capable of guiding said roll according to roll diameters of different sizes, or a second guide part capable of guiding said roll according to roll widths of different sizes, wherein said guide device comprises the second guide part;

said roll housing part comprises a fixed wall part and houses said roll with an end face on one side of said roll along a width direction in contact with said fixed wall part; and said second guide part is a guide member that is provided in a manner that can advance and retreat to said fixed wall part of said roll housing part, along a width direction of said roll, and guides a side of said print-receiving tape fed out from said roll in a width direction by contacting an end face on the other side of said roll along a width direction, wherein the label producing apparatus further comprises:

an operation member that is provided to said guide member and is capable of switching a state of said guide member into a locked state which disables advance and retreat of said guide member or into an unlocked state which enables advance and retreat of said guide member in accordance with a user operation; and plurality of first groove parts provided to a base surface of said roll housing part, along a width direction of said roll; wherein:

said operation member comprises a first protruding part capable of engaging with one of said plurality of first groove parts at a lower end portion;

said guide member becomes the locked state where said first protruding part engages with said first groove part when said operation member is not operated, and becomes the unlocked state where said first protruding part disengages from said first groove part when said operation member is operated.

2. The label producing apparatus according to claim 1, wherein:

said guide member comprises an extended part that extends toward a downstream side along a feed-out direction of said print-receiving tape;

said label producing apparatus further comprises a mounting surface where said extended part is mounted, and a plurality of second groove parts provided to said mounting surface along a width direction of said roll; wherein:

said guide member further comprises a second protruding part that is provided to a front end part of said extended part and is capable of engaging with at least one of said plurality of second groove parts; and said guide member becomes the locked state where said second protruding part engages with said second groove part when said operation member is not operated, and becomes the unlocked state where said second protruding part disengages from said second groove part when said operation member is operated.

3. The label producing apparatus according to claim 2, wherein:

said guide member further comprises a shaft member that slides along a direction orthogonal to a width direction of said roll in accordance with the operation state of said operation member; wherein:

said shaft member protrudes toward an upstream side from said guide member along a feed-out direction of said print-receiving tape when said operation member is not operated, and protrudes toward a downstream side from said guide member along a feed-out direction of said print-receiving tape when said operation member is operated;

said roll housing part further comprises an inclined surface; and said second protruding part disengages from said second groove part when a front end of said shaft member contacts said inclined surface due to protrusion of said shaft member toward the downstream side along the feed-out direction, causing a downstream side portion of said guide member along the feed-out direction to lift.

4. The label producing apparatus according to claim 1, wherein:

said guide member further comprises a grasping part onto which said user can grasp with another finger when the user operates said operation member by using one finger.

5. The label producing apparatus according to claim 1, wherein:

said guide member further comprises a support part;

said roll housing part further comprises a rail member that is provided to a base surface along a width direction of said roll, engages with said support part, and guides said guide member along an advance and a retreat direction of said guide member; and an eave member that is provided above said support part on both sides of said rail member along a width direction and prevents separation of said support part from said rail member; and said eave member is disposed in a staggered manner along a width direction of said roll on both sides of said rail member along a width direction.

6. The label producing apparatus according to claim 5, wherein:

said support part comprises two flange parts respectively provided to both sides along a width direction ofan engaging part that engages with said rail member;

said two flange parts include a first flange part positioned on an upstream side along a feed-out direction of said print-receiving tape, which is one of said both sides along the width direction, and a second flange part positioned on a downstream side along a feed-out direction of said print-receiving tape, which is the other of said both sides along the width direction; and a thickness of said first flange part is greater than a thickness of said second flange part.

7. A label producing apparatus comprising:

a roll housing part that houses a roll winding a print receiving tape into a roll shape;

a feeding roller that feeds out and transports said print-receiving tape from said roll housed in said roll housing part;

a printing device that prints desired print on said print-receiving tape fed out from said roll by the feeding of said feeding roller; and a guide device that guides said print-receiving tape fed out from said roll housed in said roll housing part; wherein:

said guide device comprises at least one of a first guide part capable of guiding said roll according to roll diameters of different sizes, and a second guide part capable of guiding said roll according to roll widths of different sizes, wherein said guide device comprises the second guide part;

said roll housing part comprises a fixed wall part and houses said roll with an end face on one side of said roll along a width direction in contact with said fixed wall part; and said second guide part is a guide member that is provided in a manner that can advance to and retreat from said fixed wall part of said roll housing part, along a width direction of said roll, and guides a side of said print-receiving tape fed out from said roll in a width direction by contacting an end face on the other side of said roll along a width direction, wherein said guide member further comprises:

a grasping part disposed between said guide member and an end face on the other side of said roll along a width direction, that forms a grasping space which said user can grasp with a finger when advancing and retreating said guide member; and a contact surface that contacts said roll; and said grasping part is formed so that said contact surface is recessed from a portion having a predetermined height to an upper end of said guide member.

8. The label producing apparatus according to claim 7, wherein:

said roll housing part houses said roll having an outer roll diameter that decreases from a maximum value to a minimum value as the print-receiving tape is fed out; and said grasping part is formed from the portion having said predetermined height that is higher than a lower end position of a roll core when said roll outer diameter is a maximum value, to an upper end of said guide member.

9. The label producing apparatus according to claim 7, wherein:

said grasping part comprises a grip surface curved toward a direction that separates away from said roll, from the portion having said predetermined height to said upper end of said guide member.

10. The label producing apparatus according to claim 9, wherein:

said guide member further comprises an operation member capable of switching a state of said guide member into a locked state which disables advance and retreat of said guide member or into an unlocked state which enables advance and retreat of said guide member, in accordance with a user operation; and said operation member further comprises a grip part curved in a same direction as said grip face of said grasping part on an upper end part.

11. A label producing apparatus comprising:

a roll housing part that houses a roll around which a print-receiving tape is wound into a roll shape;

a feeding roller that feeds out and transports said print-receiving tape from said roll housed in said roll housing part;

a printing device that prints desired print on said print-receiving tape fed out from said roll by the feeding of said feeding roller; and a guide device that guides said print-receiving tape fed out from said roll housed in said roll housing part; wherein:

said guide device comprises either a first guide part capable of guiding said roll according to roll diameters of different sizes, or a second guide part capable of guiding said roll according to roll widths of different sizes, wherein said guide device comprises the first guide part:

said first guide part is a feeding guide member that is provided on a feeding path of said print-receiving tape, between a first curvature position where said feeding path first curves after feed-out from said roll and a feeding roller position where said feeding roller and said print-receiving tape come in contact, and guides a side of said print-receiving tape fed by said feeding roller in a width direction.

12. The label producing apparatus according to claim 11, wherein:

said feeding guide member is provided on the feeding path of said print-receiving tape, between said first curvature position and a second curvature position where said feeding path curves following said first curvature position.

13. The label producing apparatus according to claim 12, further comprising a support roller that supports said print-receiving tape; wherein said second curvature position is a position where said support roller and said print-receiving tape come in contact on said feeding path.

14. The label producing apparatus according to claim 11, wherein:

said feeding guide member is arranged on one side of said print-receiving tape along a width direction, and is movably provided along the width direction of said print-receiving tape.

15. The label producing apparatus according to claim 14, further comprising: a flat surface provided between said first curvature position and said second curvature position on the feeding path of said print-receiving tape; and a plurality of groove parts provided to said flat surface along a width direction of said print-receiving tape; wherein:

said feeding guide member comprises on a lower end part a protruding part capable of engaging with one of said plurality of groove parts; and said feeding guide member becomes a locked state in which movement is disabled when said protruding part engages with said groove part, and becomes an unlocked state in which movement is enabled when said protruding part disengages from said groove part.

16. The label producing apparatus according to claim 11, further comprising:

a feed-out guide member that is provided to said roll housing part and guides a side of said print-receiving tape fed out from said roll in a width direction by contacting an end face on one side along a width direction of said roll; wherein:

said feeding guide member and said feed-out guide member are integrally configured.

* * * * *